US007123280B2

(12) United States Patent
Koyama et al.

(10) Patent No.: US 7,123,280 B2
(45) Date of Patent: Oct. 17, 2006

(54) THERMAL TRANSFER IMAGE RECEIVING SHEET AND IMAGE FORMING METHOD USING THE SAME

(75) Inventors: Hirokazu Koyama, Hino (JP); Hiroshi Watanabe, Fussa (JP); Hiroaki Yamagishi, Hachioji (JP); Hiroki Nakane, Hachioji (JP)

(73) Assignee: Konica Minolta Photo Imaging, Inc., Tokyo (JP)

( * ) Notice: Subject to any disclaimer, the term of this patent is extended or adjusted under 35 U.S.C. 154(b) by 179 days.

(21) Appl. No.: 10/944,164

(22) Filed: Sep. 17, 2004

(65) Prior Publication Data

US 2005/0068406 A1 Mar. 31, 2005

(30) Foreign Application Priority Data

Sep. 29, 2003 (JP) ..... 2003-337288

(51) Int. Cl.
*B41M 5/40* (2006.01)
*B41J 2/315* (2006.01)

(52) U.S. Cl. ..... 347/221; 428/32.39

(58) Field of Classification Search ..... 347/171, 347/172, 173, 174, 176; 428/32.39
See application file for complete search history.

(56) References Cited

U.S. PATENT DOCUMENTS

| | | | | |
|---|---|---|---|---|
| 5,958,834 | A * | 9/1999 | Yamazaki et al. | 503/227 |
| 6,389,970 | B1 * | 5/2002 | Tashiro et al. | 101/462 |
| 2005/0112493 | A1 * | 5/2005 | Shimomura et al. | 430/211 |

* cited by examiner

*Primary Examiner*—Huan Tran
(74) *Attorney, Agent, or Firm*—Lucas & Mercanti, LLP

(57) ABSTRACT

A thermal transfer image receiving sheet comprising a support having an image receiving layer on one surface of the support and a backing layer on the other surface of the support, wherein, (a) a first electrical resistance of the thermal transfer image receiving sheet is in a range of $1\times10^{8}$–$1\times10^{12}$ ohms per square before the transferable protection layer is transferred; and (b) a second electrical resistance of the thermal transfer image receiving sheet is in a range of $1\times10^{8}$–$1\times10^{12}$ ohms per square after the transferable protection layer is transferred and after the backing layer is removed, the first and second electrical resistances being measured by a salt bridge method.

9 Claims, 2 Drawing Sheets

THERMAL TRANSFER IMAGE RECEIVING SHEET AND IMAGE FORMING METHOD USING THE SAME

TECHNICAL FIELD

The present invention relates to a thermal transfer image receiving sheet and to a method of forming an image in which an image is formed by using the thermal transfer image receiving sheet and a thermal transfer sheet at least containing a transferable protection layer, more precisely relates to a thermal transfer image receiving sheet and a method of forming an image in which an anti-scratching property and an excellent antistatic property are maintained even when the image is formed by a thermal transfer method, where a transferable protection layer is transferred.

BACKGROUND

A method of forming a color or monochrome image according to a known prior art is such that an ink sheet containing thermal diffusive dye, which has the property of being diffused and transferred by heat, is placed opposite to an image receiving layer of an image receiving sheet and the thermal diffusive dye is transferred onto the image receiving layer to form an image, using a thermal printing means such as thermal head or laser. The above thermal transfer method has been acknowledged as a method that enables to form an image from digital data and also to form a high quality image comparable with a silver salt picture without using any processing solution such as a developer.

Concerning the storage stability and permanence, however, the quality of an image formed by this method has not yet reached those of a silver salt picture.

In order to improve the stability of a formed image, particularly to improve the fixing stability and light resistance, there have been disclosed thermal transfer materials using a chelatable thermal diffusive dye (hereinafter also called as a post-chelate dye) and methods of forming images (post-chelate technique) in the Japanese Patent Publication Open to Public Inspection (hereinafter referred to as JP-A) Nos. 59-78893, 59-109349 and 60-2398 for example.

As a technology of improving the mechanical permanence (e.g., abrasion resistance, grease resistance) of the image formed by a dye thermal transfer method, there has been proposed a technology for forming a transparent protection layer on an image by the thermal transfer method after the image is formed; and a process of using this technology for the image formed by the post-chelate technique has also been disclosed (refer to the Patent Document 1 for example).

When forming an image by a thermal sublimation transfer method, since the thermal transfer sheet and the thermal transfer image receiving sheet are put together and heated while conveyed through a printer, there may arise a problem that static electricity is generated resulting in a trouble in the conveyance or that dust is collected on the dye receiving layer surface of the thermal transfer image receiving sheet resulting in imperfect coloring. In addition, as a method for forming a protection layer described above, there is available a method of forming a protection layer on the formed image using a thermal transfer sheet on which a transferable protection layer has been provided beforehand. While the protection layer described above is transferred by a thermal printer, there has often been a problem that a considerable amount of static electricity is generated when the protection layer is separated from the thermal transfer sheet, resulting in a trouble in the conveyance of a thermal transfer image receiving sheet and thermal transfer sheet in the thermal printer.

In addition, when multiple image prints are piled one over another after printing, the image receiving sheets adhere to each other due to static electricity, and therefore there sometimes arises a problem that multiple image prints cannot be piled up compactly, resulting in inconvenience in handling the prints.

In order to solve the above problems, there have been proposed ideas of eliminating static electricity by providing an antistatic layer on a thermal transfer sheet (ribbon) or impregnating the thermal transfer sheet with antistatic agent in JP-A 9-52454, 7-179071, 7-179072, 6-55868, 6-99670, 10-81078, 10-118565, 10-119444, 8-300842, 9-156244, and 9-295465 for example. Recently, there have also been proposed antistatic techniques (refer to the Patent Documents 2–5 for example). With the above proposed methods, however, electrostatic charge of the thermal transfer image receiving sheet cannot be prevented fully satisfactorily.

There have also been disclosed methods of eliminating static electricity by providing an antistatic layer on the back surface of the thermal transfer image receiving sheet or impregnating the back surface with an antistatic agent in JP-A Nos. 4-366688, 5-58064, 7-1845, 8-175035, 9-207462, 10-35116, 10-44624, 10-58846, 11-157226 and 11-165469 for example. However, these proposed methods of providing a conductive layer on the back surface are not fully enough to prevent generation of static electricity on the image receiving surface.

There have also been disclosed methods of providing a conductive layer on the image receiving surface in JP-A 5-64979, 6-155949, 7-32754, 7-290845, 8-52945, 10-324072, 10-329432, 11-78255, and 11-321125. Even with these technology in which a formed image print contains a transferable protection layer, however, static electricity prevention has not been fully effective enough. With a method in which a protection layer is separated and transferred, compared to a method in which no protection layer is separated and transferred, it is supposed that the intended effect of the technique has not yet been fully produced because a lot of electric charge is generated and also because the conductive layer is destructed by the heat caused in transferring the protection layer.

There have also been disclosed methods of providing a protection layer with an antistatic agent so as to prevent electrostatic charge of the formed image print containing the transferable protection layer described above (refer to the Patent Documents 6 and 7 for example). These proposed methods are effective for electrostatic prevention of the formed image print containing a transferable protection layer, however, involve a problem that the intrinsically intended properties of the protection layer, namely permanence and storage stability of the formed image are not fully attained.

There have been proposed processes of using cellulose resin as a backing layer provided on the image receiving sheet in the thermal transfer method (refer to the Patent Documents 8 and 9). In these patent documents, however, almost no information have been disclosed on the relationship between the antistatic property and the use of cellulose resin nor on the trial to improve the antistatic property by considering the conductivity measured by the salt bridge method.

[Patent Document 1]
JP-A 2001-168244

[Patent Document 2]
JP-A 2000-103175

[Patent Document 3]
JP-A 2000-103178

[Patent Document 4]
JP-A 2000-272254

[Patent Document 5]
JP-A 2001-1653

[Patent Document 6]
JP-A 11-105437

[Patent Document 7]
JP-A 2003-145946

[Patent Document 8]
JP-A 10-297113

[Patent Document 9]
JP-A 11-181226

SUMMARY OF THE INVENTION

An object of the present invention is to provide a thermal transfer image receiving sheet and an image forming method which enable to provide a superior antistatic properties, a superior conveyance property and an excellent handling property under generated electrostatic charge, without loosing a storage stability, an abrasion resistance and an adhesion property of the image.

According to one embodiment of the present invention, a thermal transfer image receiving sheet containing a support having an image receiving layer on one surface of the support and a backing layer on the other surface of the support is provided, the image forming method including, (i) forming an image via thermal transfer on the thermal transfer image receiving sheet, and (ii) transferring a transferable protection layer from a thermal transfer sheet having a detachable transferable protection layer which is provided at least in a part of the thermal transfer sheet, wherein, (a) a first electrical resistance of the thermal transfer image receiving sheet before the transferable protection layer is transferred, and (b) a second electrical resistance of the thermal transfer image receiving sheet after the transferable protection layer is transferred and after the backing layer is removed, are in predetermined ranges which are sufficient to achieve superior anti-scratching properties, superior antistatic properties and excellent adhesion properties.

DESCRIPTION OF THE PREFERRED EMBODIMENTS

Figure 1:
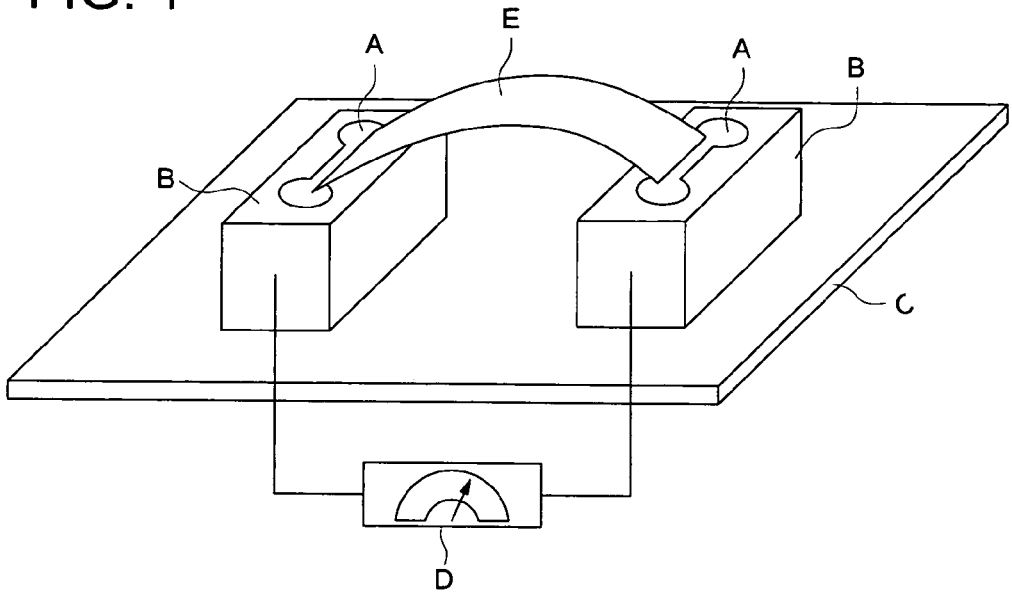
FIG. 1 is a diagram showing a typical example of the salt bridge resistance measuring apparatus used for measuring electrical resistance in the present invention.

An object of the present invention is achieved by the following structures:

1. An embodiment of the present invention includes a thermal transfer image receiving sheet comprising a support having an image receiving layer on one surface of the support and a backing layer on the other surface of the support, an image being formed by a method comprising the steps of:

(i) forming an image via thermal transfer on the thermal transfer image receiving sheet; and (ii) transferring a transferable protection layer from a thermal transfer sheet having a detachable transferable protection layer which is provided at least in a part of the thermal transfer sheet, wherein, (a) a first electrical resistance of the thermal transfer image receiving sheet is in a range of $1\times10^{8}$–$1\times10^{12}$ ohms per square before the transferable protection layer is transferred; and (b) a second electrical resistance of the thermal transfer image receiving sheet is in a range of $1\times10^{8}$–$1\times10^{12}$ ohms per square after the transferable protection layer is transferred and after the backing layer is removed, the first and second electrical resistances being measured by a salt bridge method.

2. Another embodiment of the present invention includes the thermal transfer image receiving sheet of Item 1, wherein a conductive layer containing a particle conducting agent is further provided on the same surface of the support as the image receiving layer.
3. Another embodiment of the present invention includes the thermal transfer image receiving sheet of Item 1, wherein a conductive layer containing a particle conducting agent is further provided between the support and the image receiving layer.
4. Another embodiment of the present invention includes the thermal transfer image receiving sheet of Item 2 or Item 3, wherein the conductive agent is selected from the group consisting of a conductive microparticle of crystalline metal oxide, a conductive microparticle of ionic crosslinked polymer and a microparticle of a smectite clay mineral.
5. Another embodiment of the present invention includes the thermal transfer image receiving sheet of any one of Items 2–4, wherein a content of the conductive particle in the conductive layer is in an amount of 25–80% by volume.
6. Another embodiment of the present invention includes the thermal transfer image receiving sheet of any one of Items 2–4, wherein a content of the conductive particle in the conductive layer is in an amount of 35–70% by volume.
7. Another embodiment of the present invention includes the thermal transfer image receiving sheet of any one of Items 1–6, wherein the image receiving layer has a compound containing a metal ion in the molecule which is capable of reacting with a chelatable thermal diffusive dye diffused out of a dye layer provided in the thermal transfer sheet.
8. Another embodiment of the present invention includes the thermal transfer image receiving sheet of any one of Items 1–7, wherein an outermost layer provided on an opposite surface of the support to the image receiving layer contains a cellulose resin as a main component.
9. Another embodiment of the present invention includes the method for forming the image comprising the steps of (i) forming the image via thermal transfer on the thermal transfer image receiving sheet of any one of Items 1–8; and (ii) transferring the transferable protection layer from the thermal transfer sheet having the detachable transferable protection layer which is provided at least in a part of the thermal transfer sheet.

According to the present invention, it becomes possible to provide a thermal transfer image receiving sheet and an image forming method which enable to provide a superior antistatic property, a superior conveyance property and an excellent handling property under generated electrostatic charge, without loosing a storage stability, an abrasion resistance and an adhesion property of the image.

The preferred embodiments of the present invention are described in detail hereunder, however, the invention is not limited thereto.

It was found that a superior antistatic properties, a superior conveyance property and an excellent handling property under generated electrostatic charge are realized without loosing a storage stability, an abrasion resistance and an adhesion property of the image, when the electrical resistance of the thermal transfer image receiving sheet before the transferable protection layer is transferred is in the range of $1\times10^{8}$–$1\times10^{12}$ ohms per square measured by the salt bridge method and at the same time the electrical resistance of the image receiving surface of the formed image print containing the transferred protection layer is in the range of $1\times10^{8}$–$1\times10^{12}$ ohms per square measured by the salt bridge method, of which finding is herein proposed as the invention.

Details of the invention are described hereunder.

Because the conductive layer is not always positioned at the top surface of the formed image print of the present invention to which the protection layer is transferred, the electrical resistance measured by a commonly used surface resistance measurement cannot be used as an index of conductivity. In other words, the surface resistance measurement cannot tell whether the layer itself is not conductive or the measurement just cannot detect the conduction of the layer. The conductivity of the thermal transfer image receiving sheet was examined and it was found that, even when the measured surface resistance of the image receiving sheet does not exhibit satisfactory conductivity, intended antistatic effect is achieved provided that sufficient conductivity is ensured on an inner layer other than the surface.

One of the features of the present invention is to employ an electrical resistance measured by a salt bridge method which measures the conductivity of an inner layer not positioned on the surface.

The salt bridge method in the present invention is described in detail, for example, in "Resistivity Measurement on Buried Conductive Layers" by R. A. Elder, 1990, EOS/ESD Symposium Proceedings, pp. 251–254, and the salt bridge wet electrode resistivity (WER) measurement is applicable to the present invention.

The electrical resistance measured by the salt bridge method of the present invention means the electrical resistance measured in the following manner with referring to the above described methods.

A thermal transfer image receiving sheet E in FIG. 1 before and after the transfering the protection layer is cut into 3 cm×15 cm pieces and humidity of which is conditioned by leaving the pieces under an ambient condition of 23° C. and 55% RH for 12 hours. A resistance measuring apparatus of the salt bridge method shown in FIG. 1 is installed in the same ambient condition. In FIG. 1, a pair of metal electrodes B, on each top surface of which there is provided a dent A for keeping buffer solution (for example, neutral phosphate pH reference solution (pH=6.86) manufactured by DKK-TOA Corporation) are placed on an acrylic plate C, and the end (of 3 cm wide) of each thermal transfer image receiving sheet E is inserted into each dent A of the electrode of the apparatus. Then, a voltage of 100 V is applied to a tera-ohm meter D and the electrical resistance is measured a minute later.

In the present invention, the measured electrical resistance multiplied by a factor of 3/15 is regarded as the electrical resistance measured by the salt bridge method. This electrical resistance has the same meaning as a so called "sheet resistance", accordingly the electrical resistance of the present invention is expressed by a unit of "ohms per square".

The present invention is characterized by that: (i) the electrical resistance of the thermal transfer image receiving sheet before printing measured in accordance with the above manner is in the range of $1\times10^{8}$–$1\times10^{12}$ ohms per square; and (ii) the electrical resistance, measured by the salt bridge method, of the "image receiving surface" of the thermal transfer image receiving sheet having a protective layer (after printing) is in the range of $1\times10^{8}$–$1\times10^{12}$ ohms per square. It was found that by controlling the electrical resistance within a range specified above, conveyance trouble due to the generation of static electricity, imperfect coloring due to the collection of dust on the dye receiving layer surface of the thermal transfer image receiving sheet, and handling inconvenience are prevented. The electrical resistance, measured by the salt bridge method, of the "image receiving surface" of the thermal transfer image receiving sheet containing the protection layer in the above description means the electrical resistance that is measured by the salt bridge method after layers put on an opposite surface of the support to the image receiving layer (backing layer, for example) are removed using a solvent. In the thermal transfer method in which the transferable protection layer is transferred using a thermal transfer sheet having a detachable transferable protection layer, adding the conductivity by means of the backing layer is insufficient while adding the conductivity by means of the conduction of the image receiving layer side of the sheet is effective.

<<Thermal Transfer Image Receiving Sheet>>

The thermal transfer image receiving sheet of the present invention contains at least an image receiving layer on the support but, in order to realize the electrical resistance specified by the present invention, it is preferable to further provide a conductive layer containing conductive agent.

Figure 2:
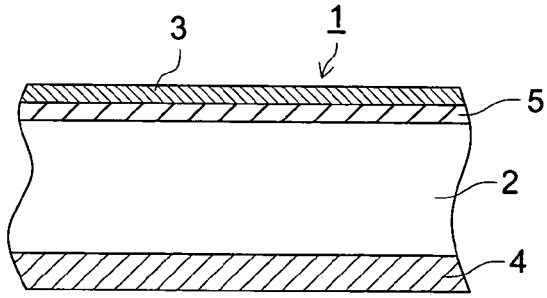
FIG. 2 is a cross-sectional view showing an example construction of the thermal transfer image receiving sheet of the present invention.

FIG. 2 is a cross-sectional view showing an example of the construction of the thermal transfer image receiving sheet of the present invention.

In FIG. 2, the thermal transfer image receiving sheet 1 comprises a support 2 and a dye receiving layer 3 provided on one side of the support 2. In addition, there is provided a conductive layer 5 containing a conductive agent between the support 2 and dye receiving layer 3. There is also provided a backing layer 4 for adjusting the curling of sheet and adding the abrasion resistance and lubrication on the other side of the support opposite to the dye receiving layer 3 side.

Components of the thermal transfer image receiving sheet of the invention are described hereunder.

[Conductive Layer]

To begin with, the conductive layer of the present invention containing a conductive agent (hereinafter also called as an antistatic layer) is described hereunder.

While there is no particular limitation to a method of realizing the electrical resistance measured by the salt bridge method as specified in the present invention, it is preferable to provide a conductive layer containing particle a conductive agent on the surface of the thermal transfer image receiving sheet of the present invention on which image is formed. It is possible to give a function of a conductive layer to the dye receiving layer, which will be described later, but providing it between the support and the dye receiving layer is preferable in view of coloring and a storage stability. Furthermore, the conductive layer may be common to an intermediate layer, may be provided between the support and intermediate layer, or may be provided between the intermediate layer and dye receiving layer.

Type of the conductive agent used for the conductive layer of the invention is not specifically limited so far as the electrical resistance measured by the salt bridge method falls under the range specified in the present invention. It, however, is preferable to use an antistatic agent in the present invention. To be concrete, it may be conductive microparticles of a crystalline metal oxide, conductive microparticles of an ionic crosslinked polymer, or a smectite clay mineral.

The conductive microparticles of a crystalline metal oxide used in the present invention shall preferably be oxides with excessive oxygen like $Nb_2O_{5+x}$, oxides with insufficient oxygen like $RhO_{2-x}$ or $IR_2O_{3-x}$, non-stoichiometric hydroxide like $Ni(OH)_x$, or oxides including $HfO_2$, $ThO_2$, $ZrO_2$, $CeO_2$, ZnO, $TiO_2$, $SnO_2$, $Al_2O_3$, $In_2O_3$, $SiO_2$, MgO, BaO, $MoO_2$, $V_2O_5$, or composite oxides thereof, and ZnO, $TiO_2$ and $SnO_2$ are specifically preferable. Doping different atoms is useful to achieve higher conductivity; for example, adding (doping) Al or In to ZnO, adding Nb or Ta to $TiO_2$, and adding Sb, Nb or halogen element to $SnO_2$ are effective. The adding quantity (doping quantity) in a range of 0.01–25 mol % is preferable, and a range of 0.1–15 mol % is specifically preferable. Of these crystalline metal oxides, antimony doped tin oxide or niobium doped titanium oxide is preferably employed in view of improving the conductivity and coloring, and antimony doped tin oxide is specifically preferable. The mean primary particle size of the conductive microparticle of a crystalline metal oxide is preferably not more than 1.0 μm, and that of not more than 0.3 μm is more preferable, and that of not more than 0.1 μm is specifically preferable. The conductive microparticle of the crystalline metal oxide may be prepared according to a process described in JP-A 56-143430. In addition, conductive microparticles made of titanium oxide particles coated with the above metal oxide is preferably employed.

Conductive microparticles of an ionic crosslinked polymer may be a polymer containing crosslinked quaternary ammonium group as disclosed in the JP-A 60-45231, for example a copolymer [N,N,N-trimethyl-N-vinyl benzyl ammonium chloride-co-divinyl benzene], or crosslinked Ionen polymer as disclosed in JP-A 7-28194, both of which are useful for the present invention.

The Ionen polymer in the above description is a polymer that has an ammonium group on its principal chain which is formed by a quaternary reaction between a diamine and a compound such as dichloride producing ammonium group, and a crosslinked Ionen polymer is a crosslinked polymer, the chain of which contains Ionen portion, wherein: (i) an Ionen unit or a polymer forms a crosslinked chain; or (ii) other monomer or a polymer forms a crosslinked chain. Conductive polymer particles including one where latex particles stabilized by a cation is bonded with a poly aniline acid adduct salt semiconductor in the specification of the U.S. Pat. Nos. 4,237,174, 4,308,332, and 4,526,706, which are also useful in the present invention. How to composite these polymers is described in each specification, and so they may be produced accordingly.

Examples of smectite clay minerals include natural montmorillonite, beidellite, nontronite and saponite, and any of these natural minerals may be used freely in the present invention. Since these minerals contain a lot of impurity and so refining them increases production cost, use of synthetic smectite clay mineral instead of natural one is preferable in the present invention.

Synthetic smectite clay minerals usable in the present invention may be for example a product named "Laponite" manufactured by a British company, Laporte Industries, Ltd. and marketed by their subsidiary, Southern Clay Products, Inc., U.S.A. It is a layered magnesium hydrate silicate where magnesium ion partly substituted with a suitable univalent ion such as lithium, sodium, potassium and/or void is coordinated in an octahedron with an oxygen and/or hydroxyl ion that may partly be substituted with fluorine ion, forming a central octahedral sheet. The octahedral sheet described above is sandwiched between two tetrahedral sheets in each of which a silica ion that is coordinated in a tetrahedron with an oxygen atom.

Laponite is available in many grades such as RD, RDS, J and S, and each has its own characteristic. Any grade is applicable to the present invention so far as it is within a range needed to ensure the conductivity.

The above smectite clay minerals are available in various sizes but the mean particle size of not more than 0.5 μm is preferable and that of not more than 0.2 μm is specifically preferable.

The content of the conductive particle in the conductive layer of the present invention containing a conductive agent is preferably 25–80% by volume, and is more preferably 35–70% by volume. In the present invention, the content of the conductive particles in the conductive layer represents the volume percentage of the conductive particle based on the total volume of the conductive particles and the binder resin. This content is important in the thermal transfer method in which the transferable protection layer is transferred using a thermal transfer sheet with a transferable protection layer that is provided detachable. When it is less than 35 vol. %, the conductivity (measured by the salt bridge method) decreases tremendously after the protection layer is transferred and, when it is less than 25 vol. %, conductivity may be lost absolutely. This, however, does not happen in the thermal transfer method in which no protection layer is transferred, and it is supposed that the above is caused because the continuity of the conductive agent in the conductive layer is destructed by pressure, heat or others at the time of protection layer transfer. In addition, adhesion between layers decreases if the volume percentage exceeds 70 vol. % and it possibly decreases to a level where the quality of the product is badly affected the volume percentage exceeds 80 vol. %, neither of which is preferable.

A binder resin used in the conductive layer including conductive agent of the present invention is not limited but suitable one may be selected in view of the adhesion with support on which it is applied or required physical property of the conductive layer. Examples of binder resin include: (i) hydrophilic binder such as gelatin and polyvinyl alcohol; (ii) cellulose type resin dissolved in organic solvent such as polyvinyl chloride, polyvinyl acetate, ethyl cellulose, hydroxy cellulose, hydroxy propyl cellulose, methyl cellulose, cellulose acetate, cellulose acetate butyrate and nitro cellulose; (iii) thermo plastic resin dissolved in organic solvent such as polyurethane resin, acrylic resin, epoxy group containing acrylic acid resin, urethane acrylate resin and polyester resin; or (iv) water dispersion containing these binder resin particle.

A curing agent such as isocyanate may also be used together with the above binder resins.

[Support]

A support used for the thermal transfer image receiving sheet is not only supposed to retain the dye receiving layer but also subjected to have a sufficient mechanical strength for smooth handling even under a heated condition in the thermal transfer process.

There is no particular limitation to the material of the support. Examples of materials of the support include, capacitor tissue paper, glassine paper, parchment paper, paper with high degree of sizing, synthetic paper (poly olefin type or polystyrene type), wood free paper, art paper, coated paper, cast coated paper, wall paper, backing paper, synthetic resin or emulsion impregnated paper, synthetic rubber latex impregnated paper, synthetic resin contained paper, cardboard, cellulose fiber paper, or film made of polyester, polyacrylate, polycarbonate, polyurethane, polyimide, polyether imide, cellulose derivative, polyethylene, ethylene—vinyl acetate copolymer, polypropylene, polystyrene, acryl, polyvinyl chloride, polyvinylidene chloride, polyvinyl alcohol, polyvinyl butyral, nylon, polyether ether ketone, polysulfone, polyether sulfone, tetrafluoro ethylene, perfluoro alkylvinyl ether, polyvinyl fluoride, tetrafluoro ethylene—ethylene, tetrafluoro ethylene—hexafluoro propylene, polychloro trifluoro ethylene, polyvinylidene fluoride; or white transparent film made from the above synthetic resin mixed with white dye and filler or foamed film made from the above material is also usable.

A laminate of a combination of any of the above base materials is also usable. A typical laminate is a synthetic paper made from a combination of a cellulose fiber paper and a synthetic paper or a cellulose synthetic paper and a plastic film. The thickness of the support may be any but normally ranges from 10–300 μm.

In order to achieve higher print sensitivity as well as higher image quality without any unevenness of density and omission of print, it is preferred to provide a layer containing micro voids. For the layer containing micro voids, a plastic film or a synthetic paper containing micro voids in its inside may be used. Otherwise, a layer containing micro voids may be formed on various types of supports by various coating processes. A preferable plastic film or a synthetic paper containing micro voids is mainly made from polyolefin or specifically from polypropylene; that is, inorganic pigment and/or a polymer incompatible with polypropylene is blended with the above material as a void forming initiator and the blend is stretched and formed into film. If the film or the paper is mainly made from polyester, it has less cushion and thermal insulation than the one mainly made from polypropylene, and accordingly print sensitivity is low and unevenness of density is easily caused.

In view of the above, a preferable elastic modulus of the plastic film or the synthetic paper at 20° C. is $5\times10^{8}$Pa–$1\times10^{10}$Pa. Since this plastic film or synthetic paper is formed into film generally by 2-axis drawing, it shrinks under heat. Its shrinkage-factor is 0.5–2.5% when left to stand at 110° C. for 60 seconds. The above plastic film or the synthetic paper may be a single-layer of itself containing micro voids or may constitute multiple layers. In the case of multiple layers, it may be possible that all layers contain micro voids or that some does not contain micro voids. It may be possible to mix white pigment, as needed, as a masking agent in this plastic film or synthetic paper. It may also be possible to mix fluorescent whitener in order to increase whiteness. Preferable thickness of the layer containing micro voids is 30–80 μm.

The layer containing micro voids may also be formed by a coating process on the support. A plastic resin to be coated may be one of or a blend of known types of resins such as polyester, urethane resin, polycarbonate, acrylic resin, polyvinyl chloride, and polyvinyl acetate.

If necessary, a layer made of a resin such as polyvinyl alcohol, polyvinylidene chloride, polyethylene, polypropylene, modified polyolefin, polyethylene terephthalate, and polycarbonate or a layer of synthetic paper may be provided on the other side of the support opposite to the image receiving layer side so as to prevent curling. A known laminating process such as dry lamination process, non-solvent (hot melt) lamination process or an EC lamination process is applicable to adhere the layer, but dry lamination process and non-solvent lamination process are preferable. Adhesive suitable for the non-solvent dry lamination process is for example Takenate 720L manufactured by Takeda Pharmaceutical Co., Ltd. Adhesive suitable for the dry lamination process is for example Takelac A969/Takenate A-5 (3/1) manufactured by Takeda Pharmaceutical Co., Ltd. or Polyzole PSA SE-1400 and Vinylole PSA AV-6200 Series manufactured by Showa Highpolymer Co., Ltd. The necessary amount of the above adhesive is in a range of about 1–8 g/m$^2$, preferably 2–6 g/m$^2$.

An adhesion layer may be used to laminate (i) plastic films and synthetic papers, (ii) plastic films each other, (iii) synthetic papers each other, (iv) various types of papers and plastic films or (v) synthetic papers.

In order to increase the adhesion strength between the support and dye receiving layer, providing primer treatment or corona discharge treatment on the surface of the support is preferable.

[Dye Receiving Layer]

The dye receiving layer provided on the thermal transfer image receiving sheet is to receive sublimated dye transferred from the thermal transfer sheet and maintain the formed image.

<Binder Resin>—

The binder resin for forming the dye receiving layer may be a simple substance of or a mixture of polyolefin resin such as polypropylene, halogenated resin such as polyvinyl chloride and polyvinylidene chloride, vinyl type resin such as polyvinyl acetate and ester polyacrylate, polyester resin such as polyethylene terephthalate and polybutylene terephthalate, polystyrene type resin, polyamide type resin, phenoxy resin, copolymer of olefin such as ethylene and propylene with other vinyl type monomer, polyurethane, polycarbonate, acrylic resin, Ionomer, and cellulose derivative. Among these, polyester type resin, vinyl type resin and cellulose derivative are preferable.

<Release Agent>

It is preferable to add a release agent to the dye receiving layer of the present invention in order to prevent thermal fusion with the dye layer. Applicable release agent includes phosphoric ester type plasticizer, fluorine type compound, and silicone oil (including reaction curing type silicone), but silicone oil is preferable. Silicone oil may be various types of modified silicone including dimethyl silicone. To be concrete, amino modified silicone, epoxy modified silicone, alcohol modified silicone, vinyl modified silicone, and urethane modified silicone are applicable either by blending them or polymerizing them in various processes. The release agent may be of a single type or mixture of multiple types. The amount of release agent to be added is preferably 0.5–30 weight parts compared to 100 weight parts of the binder resin for forming the dye receiving layer. If the amount of addition is out of the above range, there may arise a problem of fusion between the thermal transfer sheet and dye receiving layer of the thermal transfer image receiving sheet or decrease in the print sensitivity. Instead of adding the release agent to the dye receiving layer, it is permissible to provide a separate release layer on the dye receiving layer.

<Compound Containing Metal Ion>

It is preferable that the dye receiving layer of the present invention contains compound containing metal ion (hereinafter also called as metal source).

A metal source may be an inorganic or organic salt of a metal ion and a metal complex, and organic salt and complex are specifically preferable. A metal includes univalent and polyvalent metals belonging to Group I to VIII in the Periodic Table and Al, Co, Cr, Cu, Fe, Mg, Mn, Mo, Ni, Sn, Ti and Zn are preferable, Ni, Cu, Cr, Co and Zn are specifically preferable. Typical metal source may be a salt of $Ni^{2+}$, $Cu^{2+}$, $Cr^{2+}$, $Co^{2+}$ or $Zn^{2+}$ with an aliphatic acid for example acetic acid or stearic acid or with aromatic carboxy acids such as benzoic acid or salicylic acid.

Specifically preferable metal source in the present invention is a complex that is described by the following General Formula (I) because it may be stably added to the binder resin in a post-heat area and is practically colorless.

$$[M(Q_1)_X(Q_2)_Y(Q_3)_Z]^{P+}(L^-)_P \qquad \text{General Formula (I)}$$

In General Formula (I), M represents a metal ion, which is preferably $Ni^{2+}$, $Cu^{2+}$, $Cr^{2+}$, $Co^{2+}$ or $Zn^{2+}$. Each $Q_1$, $Q_2$ and $Q_3$ represents a coordination compound that may coordinate to a metal ion, and they may be of the same or different. This coordination compound may be selected for examples from the coordination compounds listed in "Chelate Science (5)" published by Nanko-do Publishing. $L^-$ represents an organic anion group, which may concretely be a tetraphenyl boron anion or an alkylbenzene sulfonate anion. X stands for 1, 2 or 3, Y stands for 1, 2 or 0, and Z stands for 1 or 0. P stands for 1 or 2. A concrete example of the metal source of this type includes a compound shown in the specification of the U.S. Pat. No. 4,987,049, compounds Nos. 1 to 99 in JP-A 9-39423. Specifically preferable one is described in JP-A 10-241410, which is described by the following General Formula (II).

$$M^{2+}(X_1^-)_2 \qquad \text{General Formula (II)}$$

In the above General Formula (II), $M^{2+}$ represents a divalent transition metal ion, and nickel and zinc are preferable among the divalent transition metal ions in view of the color of the compound itself which supplies the metal ion and the tone of the chelated dye. $X_1^-$ represents a coordination compound which forms a complex with a divalent metal ion. In addition, the above compound may contain a neutral ligand in accordance with its center metal; and a typical ligand may be $H_2O$ or $NH_3$.

[Intermediate Layer]

In addition to the conductive layer of the present invention, an intermediate layer may be further provided between a support and a dye receiving layer of the thermal transfer image receiving sheet. The function of this intermediate layer is to add solvent resistance, barrier capability, adhesion, whitening and masking but, not limited thereto, and any known intermediate layer is applicable.

In order to add the solvent resistance and barrier performance to the intermediate layer, use of a water soluble resin is preferable. Water soluble resin may be cellulose type resin such as carboxy methylcellulose, polysaccharide resin such as starch, protein such as casein, gelatin, agar, and a vinyl type resin such as polyvinyl alcohol, ethylene vinyl acetate copolymer, polyvinyl acetate, vinyl chloride, vinyl acetate copolymer (for example, Beopa manufactured by Japan Epoxy Resin Co., Ltd.), vinyl acetate (meth) acryl copolymer, (meth) acrylic resin, styrene (meth) acryl copolymer and styrene resin, and polyamide type resin such as melamine resin, urea resin and benzo guanamine resin, polyester, and polyurethane. Water soluble resin means a resin that is dissolved completely (particle size of not more than 0.01 μm) in water based solvent or into a colloidal dispersion state (0.01–0.1 μm), emulsion state (0.1–1 μm) or slurry state (not less than 1 μm). Specifically preferable water soluble resin is a resin that neither dissolves nor swells in alcohols such as methanol, ethanol and isopropyl alcohol, and conventional solvent such as hexane, cyclohexane, acetone, methyl ethyl ketone, xylene, ethyl acetate, butyl acetate and toluene. This means a resin that is completely dissolved in water-based solvent is the most preferable. Polyvinyl alcohol resin and cellulose resin are specifically preferable.

In order to add adhesion to the intermediate layer, urethane type resin and polyolefin type resin are generally employed, which however depends upon the type of the support and surface treatment to be applied. Excellent adhesion may be achieved by the use of thermoplastic resin containing active hydrogen together with a curing agent such as isocyanate compound. In order to add whitening to the intermediate layer, fluorescent whitener may be employed. Any known compound is applicable as the fluorescent whitener, including stilbene type, distilbene type, benzo oxazole type, styrile-oxazole type, pyrene-oxazole type, coumarin type, amino coumarin type, imidazole type, benzo imidazole type, pyrazoline type, and distyrile-biphenyl type fluorescent whiteners. Whiteness may be adjusted by the type and amount of the fluorescent whitener to be added. Any process for adding the fluorescent whitener is applicable. That is, by dissolving it into water to add, by grinding and dispersing it with a ball mill or a colloid mill to add, by dissolving it into high boiling-point solution and mixing it with hydrophilic colloid solution to add as oil in water type dispersion, or by impregnating in high-polymer latex.

In addition, in order to mask glare and irregularity, titanium oxide may be added to the intermediate layer. Use of titanium oxide is preferable because the freedom in selecting the material of the support becomes wider. Titanium oxide is available in two types: rutile type and anatase type, of which the anatase type titanium oxide is more preferable than the rutile type because its ultraviolet absorption is more on the shortwave side. If the binder resin of the intermediate layer is of water type and accordingly titanium oxide can not be dissolved easily, oxide titanium of which surface is subjected to a hydrophilic treatment is employed or known dispersing agent such as surface active agent or ethylene glycol is employed to disperse the titanium oxide. Preferable amount of titanium oxide to be added is 10–400 weight parts of solid compared to 100 weight parts of resin solid.

[Backing Layer]

The backing layer may be of multi-layer structure comprising laminated multiple layers but the main component of the top layer is preferably cellulose resin such as ethyl cellulose, hydroxy cellulose, hydroxy propyl cellulose, methyl cellulose, cellulose acetate, cellulose acetate butyrate, and nitro cellulose. By a combination of the above with the conductivity measured by the salt bridge method, antistatic property including smooth handling is further improved. Detailed reason for this is not known but we supposed this is because the charged array of the cellulose resin is positioned relatively intermediate and so relatively less electric charge is generated. It is permissible to add conventional known additives including conductive agent and matting agent to the backing layer.

<<Thermal Transfer Sheet>>

The thermal transfer sheet of the present invention comprises each dye layer that contains dye and detachable transferable protection layer.

Figure 3:
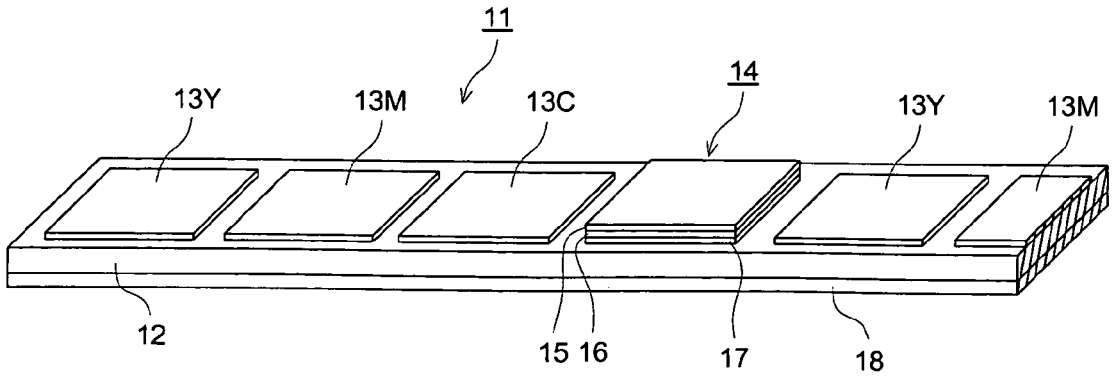
FIG. 3 is an oblique view showing the thermal transfer sheet of the present invention being fed sequentially.

FIG. 3 is an oblique view of an example of the thermal transfer sheet of the present invention which is a continuous sheet form to be fed sequentially. As shown in FIG. 3, the thermal transfer sheet has dye layers 13Y, 13M and 13C, each corresponding to yellow (Y), magenta (M) and cyan (C), on the same side of the support 11, on which a transferable protection layer unit 14 containing detachable transferable protection layer is provided one after another independently from the dye layers. The transferable protection layer unit 14 is provided with a non-transferable separation layer 15, transferable protection layer 16 and adhesion layer 17 in this order on the support 12. On the other side of the support 12, a heat-resisting lubrication layer 18 is provided. The transferable protection layer 16 may be a laminate of protection layer and adhesion layer.

In FIG. 3, a small space is provided between each dye layer and between a dye layer and transferable protection layer unit 14, but this space may be adjusted as needed according to the control system of a thermal transfer recording unit. In addition, in order to set each dye layer more accurately at its start position, it is preferable to put detection marks on the thermal transfer sheet. The marks may be put in any manner without limitation. This example shows a support on the same side of which dye layers and thermally transferable protection layer, or areas for post-heat treatment, are provided. Needless to say, however, each of these layers may be provided separately on an individual support. When reaction type dye is employed on each dye layer, the dye contained in the dye layer is a compound that has not been reacted yet. Namely, strictly speaking, they are not yet Y, M and C dyes, but this description is used for convenience sake because they are the layers for forming Y, M and C image in the end.

[Support]

The support of the thermal transfer sheet of the present invention may be of any conventional known material applicable as the support of the thermal transfer sheet. Examples of preferable materials of the support include, thin paper such as glassine paper, capacitor tissue paper and paraffin paper, stretched or non-stretched film of high heat-resisting polyester such as polyethylene terephthalate, polyethylene naphthalate, polybutylene terephthalate, polyphenylene sulfide, polyether ketone and polyether sulfone, that of polypropylene, fluorocarbon resin, polycarbonate, cellulose acetate, polyethylene derivative, polyvinyl chloride, polyvinylidene chloride, polystyrene, polyamide, polyimide, polymethyl pentene and Ionomer, or lamination of these. The thickness of the support may be determined depending upon each material so as to achieve appropriate strength and heat resistance, and preferable thickness is normally about 1–100 μm.

If adhesion of the dye layers with the surface of the support is not sufficient, the surface is preferably subjected to primer treatment or corona treatment.

[Dye Layer]

The dye layer constituting the thermal transfer sheet of the present invention is a thermal sublimation dye layer at least containing dye and binder resin.

<Dye>

The dye contained area provided on the thermal transfer sheet of the present invention may be two or more areas containing dyes of different hue; for example, there may be an embodiment where the dye contained area comprises an area containing yellow dye, area containing magenta dye and area containing cyan dye and also an area not containing dye is formed next to these dye contained areas; there may be another embodiment, where the dye contained area is an ink layer containing black dye and an area not containing dye is formed next to the area; or there may be another embodiment, where the dye contained area comprises an area containing yellow dye, area containing magenta dye, area containing cyan dye and area containing black dye and also an area not containing dye is formed next to these dye contained areas.

Dyes used on the thermal sublimation dye layer are not limited and may be any dye including azo type, azo methine type, methine type, anthra quinone type, quino phthalone type, and naphtho quinone type that is used on a conventional known thermal sublimation transfer type thermal transfer sheet. To be concrete, yellow dye may be Foron Brilliant yellow S-6GL, PTY-52, and Macrolex yellow 6G; red dye may be MS red G, Macrolex red violet R, Ceres red 7B, Summalone red HBSL, and SK Rubin SEGL; and blue dye may be Kayaset blue 714, Waxoline blue AP-FW, Foron Brilliant blue S-R, MS blue 100, and Daito blue No. 1.

There is not limitation to chelatable thermal diffusive dye so far as it may be thermally transferred and any known type of compound may be selected as needed. For example, cyan dyes, magenta dyes and yellow dyes described in the specification of JP-A 59-78893 (1983), 59-109349 (1983), 4-94974 (1992), 4-97894 (1992) and Japanese Patent No. 2,856,225 are applicable.

For example, chelate cyan dye may be a compound expressed by the following General Formula (1).

General Formula (1)

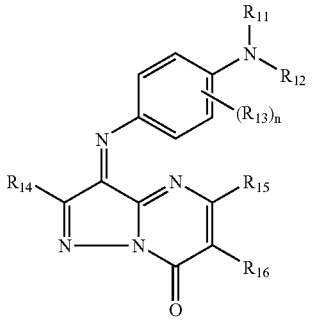

In the above General Formula (1), each $R_{11}$ and $R_{12}$ represents substituted or not-substituted aliphatic group, and $R_{11}$ and $R_{12}$ may be of the same or different. Aliphatic group may be for example alkyl group, cycloalkyl group, alkenyl group, and alkynyl group. Alkyl group may be for example methyl group, ethyl group, propyl group, and i-propyl group, and a group that substitutes this alkyl group may be normally chained or branched alkyl group (for example, methyl group, ethyl group, i-propyl group, t-butyl group, n-dodecyl group, and 1-hexylnonyl group), cycloalkyl group (for example, cyclopropyl group, cyclohexyl group, bicyclo [2.2.1] heptyl group, and adamantyl group), and alkenyl group (for example, 2-propyrene group and oleyl group), aryl group (for example, phenyl group, ortho-tolyl group, ortho-anisyl group, 1-naphthyl group, and 9-anthranyl group), heterocyclic group (for example, 2-tetrahydro furyl group, 2-thiophenyl group, 4-imidazolyl group, and 2-pyridyl group), halogen atom (for example, fluorine atom, chloride atom, and bromine atom), cyano group, nitro group, hydroxy group, carbonyl group (for example, alkyl carbonyl group such as acethyl group, trifluoro acethyl group, and pivaloyl group, and anyl carbonyl group such as benzoyl group, pentafluoro benzoyl group, and 3,5-di-t-butyl-4-hydroxy benzoyl group), oxycarbonyl group (for example, aryl oxycarbonyl group such as alkoxy carbonyl group such as methoxy carbonyl group, cyclohexyl oxycarbonyl group, and n-dodecyl oxycarbonyl group, phenoxy carbonyl group, 2,4-di-t-amyl phenoxycarbonyl group, and 1-naphthyl oxycarbonyl group, and heterocyclic oxycarbonyl group such as 2-pyridyl oxycarbonyl group, and 1-phenyl pyrazolyl-5-oxycarbonyl group), carbamoyl group (for example, alkyl carbamoyl group such as dimethyl carbamoyl group and 4-(2,4-di-t-amyl phenoxy) butyl amino carbonyl group, and aryl carbamoyl group such as phenyl carbamoyl group and 1-naphthyl carbamoyl group), alkoxy group (for example, methoxy group and 2-ethoxy ethoxy group), aryl oxy group (for example, phenoxy group, 2,4-di-t-amylphenoxy group, and 4-(4-hydroxy phenyl sulphonyl) phenoxy group), heterocyclic oxy group (for example, 4-pyridyl oxy group, 2-hexahydro pyranyl oxy group), carbonyl oxy group (for example, alkyl carbonyl oxy group such as acethyl oxy group, trifluoro acethyl oxy group, and pivaloyl oxy group, and aryl oxy group such as benzoyl oxy group and pentafluoro benzoyl oxy group), urethane group (for example, alkyl urethane group such as N,N-dimethyl urethane group, and aryl urethane group such as N-phenyl urethane group and N-(p-cyano phenyl) urethane group), sulphonyl oxy group (for example, alkyl sulphonyl oxy group such as methane sulphonyl oxy group, trifluoro methane sulphonyl oxy group, and n-dodecane sulphonyl oxy group, and aryl sulphonyl oxy group such as benzene sulphonyl oxy group and p-toluene sulphonyl oxy group), amino group (for example, alkyl amino group such as dimethyl amino group, cyclohexyl amino group, and n-dodecyl amino group, and aryl amino group such as anylino group and p-t-octyl anylino group), sulphonyl amino group (for example, alkyl sulphonyl amino group such as methane sulphonyl amino group, heptafluoro propane sulphonyl amino group, and n-hexadecyl sulphonyl amino group, and aryl sulphonyl amino group such as p-toluene sulphonyl amino group and pentafluoro benzene sulphonyl amino group), sulfamoyl amino group (for example, alkyl sulfamoyl amino group such as N,N-dimethyl sulfamoyl amino group, and aryl sulfamoyl amino group such as N-phenyl sulfamoyl amino group), acyl amino group (for example, alkyl carbonyl amino group such as acethyl amino group and myristoyl amino group, and aryl carbonyl amino group such as benzoyl amino group), ureido group (for example, alkyl ureido group such as N,N-dimethyl amino ureido group, and aryl ureido group such as N-phenyl ureido group and N-(p-cyano phenyl) ureido group), sulphonyl group (for example, alkyl sulphonyl group such as methane sulphonyl group, and aryl sulphonyl group such as trifluoro methane sulphonyl group and p-toluene sulphonyl group), sulfamoyl group (for example, alkyl sulfamoyl group such as dimethyl sulfamoyl group and 4-(2,4-di-t-amyl phenoxy) butyl amino sulphonyl group, and aryl sulfamoyl group such as phenyl sulfamoyl group), alkyl thio group (for example, methyl thio group and t-octyl thio group), aryl thio group (for example, phenyl thio group), and heterocyclic thio group (for example, 1-phenyl tetrazole-5-thio group and 5-methyl-1,3,4-oxadiazole-2-thio group).

The same substitution group as above applies to cyclo alkyl group and alkenyl group. For alkynyl group, 1-propyne, 2-butyne, and 1-hexyne are applicable.

For $R_{11}$ and $R_{12}$, a group that forms non-aromatic cyclic structure (for example, pyrrolidine ring, piperidine ring, and morpholine ring) is also preferable.

For $R_{13}$, alkyl group, cyclo alkyl group, alkoxy group, and acyl amino group are preferable among the above substitution groups. "n" represents an integer of 0–4 and, if "n" is 2 or greater, multiple $R_{13}$'s may be of the same or different.

$R_{14}$ is alkyl group, which may be for example methyl group, ethyl group, i-propyl group, t-butyl group, n-dodecyl group, and 1-hexyl nonyl group. $R_{14}$ is preferably secondary or tertiary alkyl group, and preferable secondary or tertiary alkyl group includes isopropyl group, sec-butyl group, tert-butyl group, and 3-heptyl group. The most preferable substitution group for $R_{14}$ is isopropyl group and tert-butyl group. The alkyl group $R_{14}$ may have been substituted but it is substituted with a group consisting completely of carbon atoms and hydrogen atoms and it cannot be substituted with a substitution group containing other atoms.

$R_{15}$ is alkyl group, which may be for example n-propyl group, i-propyl group, t-butyl group, n-dodecyl group, and 1-hexyl nonyl group. $R_{15}$ is preferably secondary or tertiary alkyl group, and preferable secondary or tertiary alkyl group includes isopropyl group, sec-butyl group, tert-butyl group, and 3-heptyl group. The most preferable substitution group for $R_{15}$ is isopropyl group and tert-butyl group. The alkyl group $R_{15}$ may have been substituted but it is substituted with a group consisting completely of carbon atoms and hydrogen atoms and it cannot be substituted with a substitution group containing other atoms.

$R_{16}$ is alky group, which may be for example n-propyl group, n-butyl group, n-pentyl group, n-hexyl group, n-heptyl group, isopropyl group, sec-butyl group, tert-butyl group, and 3-heptyl group. The most preferable substitution group for $R_{16}$ is normally chained alkyl group with the number of carbon of 2 or more, which may be for example n-propyl group, n-butyl group, n-pentyl group, n-hexyl group, and n-heptyl group; among which n-propyl group and n-butyl group are the most preferable. The alkyl group $R_{16}$ may have been substituted but it is substituted with a group consisting completely of carbon atoms and hydrogen atoms and it cannot be substituted with a substitution group containing other atoms.

Chelate yellow dye may be a compound expressed by the following General Formula (2).

General Formula (2)

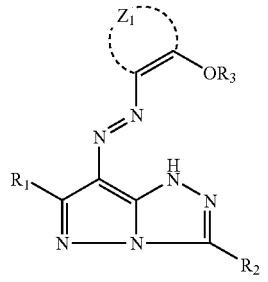

In the above General Formula (2), each substitution group represented by $R_1$ and $R_2$ may be halogen atom, alkyl group (alkyl group with the number of carbon of 1 to 12 that is substituted with a substitution group coupled with oxygen atom, nitrogen atom, sulfur atom or carbonic group or substituted with aryl group, alkenyl group, alkynyl group, hydroxyl group, amino group, nitro group, carboxyl group, cyano group, or halogen atom. For example, this may be methyl group, isopropyl group, t-butyl group, trifluoro methyl group, methoxy methyl group, 2-methane sulphonyl ethyl group, 2-methane sulphone amide ethyl group, and cyclohexyl group), aryl group (for example, phenyl group, 4-t-butyl phenyl group, 3-nitro phenyl group, 3-acyl amino phenyl group, and 2-methoxy phenyl group), cyano group, alkoxyl group, aryl oxy group, acyl amino group, anylino group, ureido group, sulfamoyl amino group, alkyl thio group, aryl thio group, alkoxy carbonyl amino group, sulphone amide group, carbamoyl group, sulfamoyl group, sulphonyl group, alkoxy carbonyl group, heterocyclic oxy group, acyl oxy group, carbamoyl oxy group, sirile oxy group, aryl oxy carbonyl amino group, imide group, heterocyclic thio group, phosphonyl group, and acyl group.

Alkyl group and aryl group represented by $R_3$ may be of the same alkyl group and aryl group represented by $R_1$ and $R_2$.

To be concrete, pentacyclic to hexacyclic aromatic ring represented by $Z_1$, composed together with two carbon atoms, may be a ring of benzene, pyridine, pyrimidine, triazine, pyrazine, pyridazine, pyrrole, furan, thiophene, pyrazole, imidazole, triazole, oxazole, and thiazole, and this ring may further form a fused ring together with other aromatic ring. This ring may have a substitution group on it and the substitution group may be of the same substitution group represented by $R_1$ and $R_2$.

Chelate magenta dye may be a compound expressed by the following General Formula (3).

General Formula (3)

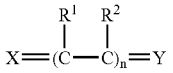

In the above General Formula (3), X represents a mass of at least 2-locus chelatable groups or atoms, Y represents a mass of atoms forming pentacyclic or hexacyclic aromatic hydrocarbon ring or heterocyclic ring, and each $R^1$ and $R^2$ represents hydrogen atom, halogen atom or univalent substitution group. "n" stands for 0, 1 or 2.

Specifically preferable compound for X is a group expressed by the following General Formula (4).

General Formula (4)

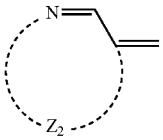

In the above General Formula (4), $Z_2$ represents a mass of atoms necessary for forming aromatic nitrogen-contained heterocyclic ring substituted with a group that contains at lease one chelatable nitrogen atom. Typical example of this ring is pyridine ring, pyrimidine ring, thiazole ring, and imidazole ring. The ring may form a fused ring together with other carbon ring (benzene ring for example) or heterocyclic ring (pyridine ring for example).

In the above General Formula (3), Y represents a mass of atoms that form pentacyclic or hexacyclic aromatic hydrocarbon ring or heterocyclic ring, and this ring may have another substitution group or fused ring on itself. Typical example of the ring is 3H-pyrole ring, oxazole ring, imidazole ring, thiazole ring, 3H-pyrorydine ring, oxazolidine ring, imidazolidine ring, thiazolidine ring, 3H-idole ring, benzoxazole ring, benzimidazole ring, benzothiazole ring, quinoline ring, and pyridine ring. The ring may form a fused ring together with other carbon ring (benzene ring for example) or heterocyclic ring (pyridine ring for example). Substitution group on the ring includes alkyl group, aryl group, hetero group, acyl group, amino group, nitro group, cyano group, acyl amino group, alkoxy group, hydroxyl group, alkoxy carbonyl group, and halogen atom, and this group may further be substituted with another.

Each $R^1$ and $R^2$ represents hydrogen atom, halogen atom (fluorine atom or chloride atom, for example) or univalent substitution group, and typical univalent group is for example alkyl group, alkoxy group, cyano group, alkoxy carbonyl group, aryl group, hetero-ring group, carbamoyl group, hydroxy group, acyl group, and acyl amino group.

X represents a mass of at least 2-locus chelatable groups or atoms, and anything that may form dye in accordance with the General Foemula (3) is applicable. Preferably, it shall be for example 5-pyrazolone, imidazole, pyrazolo pyrrole, pyrazolo pyrazole, pyrazolo imidazole, pyrazolo triazole, pyrazolo tetrazole, barbitulic acid, thio barbitulic acid, rhodanine, hydantoin, thiohydantoin, oxazolone, isooxazolone, indandione, pyrazolidine dione, oxazolidine dione, hydroxy pyridone, and pyrazolo pyridone.

<Binder Resin>

The dye layer of the present invention contains binder resin along with the above dye.

Binder resin used on the dye layer may be any binder resin that is used on a conventional known thermal sublimation transfer type thermal transfer sheet. It may be for example cellulose resin such as cellulose added compound, cellulose ester, and cellulose ether, polyvinyl acetal resin such as polyvinyl alcohol, polyvinyl formale, polyvinyl acetoacetal, and polyvinyl butyral, vinyl type resin such as polyvinyl pyrrolidone, polyvinyl acetate, polyacryl amide, styrene type resin, poly (meth) acrylic acid type ester, poly (meth) acrylic acid, and (meth) acrylic acid copolymer, rubber type resin, Ionomer resin, olefin type resin, and polyester resin. Among these, polyvinyl butyral, polyvinyl acetoacetal, and cellulose type resin are preferable because of excellent conservativeness.

Furthermore, any of the following is also applicable as binder resin of the dye layer: reaction product between the isocyanat group disclosed in the Japanese Patent Publication No. HEI 5-78437 (1993) and an active-hydrogen contained compound selected from polyvinyl butyral, polyvinyl formale, polyester polyol, or acryl polyol, the above reaction product wherein isocyanate group is diisocyanate or triisocyanate, and the above reaction product of which quantity is 10 to 200 weight parts compared to 100 weight parts of the active-hydrogen contained compound; organic-solvent soluble high polymer made of natural and/or semi-synthetic water soluble high polymer of which intermolecular hydroxyl group is esterified and/or urethanified, and natural and/or semi-synthetic water soluble high polymer; cellulose acetate disclosed in JP-A 3-264393 (1991) of which degree of acetylation is not less than 2.4 and degree of total substitution is not less than 2.7; vinyl resin such as polyvinyl alcohol (Tg=85° C.), polyvinyl acetate (Tg=32° C.), and vinyl chloride/vinyl acetate copolymer (Tg=77° C.), polyvinyl acetal type resin such as polybutyl butyral (Tg=84° C.) and polyvinyl acetoacetal (Tg=110° C.), vinyl type resin such as polyacryl amide (Tg=165° C.), and polyester resin such as aliphatic polyester (Tg=130° C.); reaction product between the isocyanate group disclosed in JP-A 7-52564 (1995) and polyvinyl butyral that contains vinyl alcohol of 15 to 40% by weight, and the above reaction product wherein isocyanate group is diisocyanate or triisocyanate; phenyl isocya modified polyvinyl acetal resin according to the general expression (1) disclosed in JP-A 7-32742 (1995); cured composite that contains one of the isocyanate reactive cellulose or isocyanate reactive acetal resin disclosed in JP-A 6-155935 (1994), one of isocyanate reactive acetal resin, isocyanate reactive vinyl resin, isocyanate reactive acrylic resin, isocyanat reactive phenoxy resin and isocyanate reactive styrene, and polyisocyanate compound; polyvinyl butyral resin (preferably, of which molecular weight is not less than 60,000, glass transition temperature is not less than 60° C., more preferably not less than 70° C. and not more than 110° C., and weight percentage of its vinyl alcohol is 10–40% of polyvinyl butyral resin, more preferably 15–30%); and acryl modified cellulose type resin, wherein cellulose type resin may be ethyl cellulose, hydroxy ethyl cellulose, ethyl hydroxy cellulose, hydroxy propyl cellulose, methyl cellulose, cellulose acetate, and butyrate acetate cellulose (among which ethyl cellulose is preferable).

Of the various types of binder resin described above, any may be used alone or in mixture.

In addition to the dye and binder resin mentioned above, the dye layer of the present invention may contain various types of known additives if necessary. The dye layer may be formed for example in the following process: the above dye, binder resin and other additives are dissolved or dispersed into appropriate solvent to produce ink solution for coating; and the support is coated with the prepared solution by a known means such as photogravure coating process and then dried. The thickness of the dye layer of the present invention shall be about 0.1–3.0 μm, preferably about 0.3–1.5 μm.

(Transferable Protection Layer)

One of the features of the present invention is that the thermal transfer sheet is provided with detachable transferable protection layer. The detachable transferable protection layer, which serves as a protection layer covering the surface of the image formed on the image receiving sheet by thermal transfer, is mainly made of transparent resin layer.

Resin used for the transferable protection layer may be for example polyester resin, polystyrene resin, acrylic resin, polyurethane resin, acryl urethane resin, polycarbonate resin, epoxy modified resin of any of the above, silicone modified resin of any of the above, mixture of any of the above, ionizing radiation curable resin, and ultraviolet blocking resin. Among these, polyester resin, polycarbonate resin, epoxy modified resin, and ionizing radiation curable resin are preferable. Preferable polyester resin is aliphatic polyester resin of which diol component and acid component contain one or more aliphatic compounds. Preferable polycarbonate resin is aromatic polycarbonate resin, and the aromatic polycarbonate resin disclosed in JP-A 11-151867 (1999) is specifically preferable.

Epoxy modified resin used in the present invention may be epoxy modified urethane, epoxy modified polyethylene, epoxy modified polyethylene terephthalate, epoxy modified polyphenyl sulfite, epoxy modified cellulose, epoxy modified polypropylene, epoxy modified polyvinyl chloride, epoxy modified polycarbonate, epoxy modified acryl, epoxy modified polystyrene, epoxy modified polymethyl methacrylate, epoxy modified silicone, copolymer of epoxy modified polystyrene and epoxy modified polymethyl methacrylate, copolymer of epoxy modified acryl and epoxy modified polystyrene, and copolymer of epoxy modified acryl and epoxy modified silicone, among which epoxy modified acryl, epoxy modified polystyrene, epoxy modified polymethyl methacrylate, and epoxy modified silicone are preferable, and copolymer of epoxy modified polystyrene and epoxy modified polymethyl methacrylate, copolymer of epoxy modified acryl and epoxy modified polystyrene, and copolymer of epoxy modified acryl and epoxy modified silicone are more preferable.

<Ionizing Radiation Curable Resin>

Ionizing radiation curable resin is applicable to the transferable protection layer because of its excellent plasticizer resistance and abrasion resistance. Any known type of ionizing radiation curable resin is applicable; for example, there is available a resin made of radical polymerizing polymer or oligomer crosslinked and cured by ionizing radiation, to which photochemical polymerization initiator is added if necessary, and then polymerized and crosslinked by electron beam or ultraviolet beam.

<Ultraviolet Blocking Resin>

The transferable protection layer containing ultraviolet blocking resin aims mainly to add light resistance to the print. Ultraviolet blocking resin may be for example a resin produced by reacting and bonding reactive ultraviolet absorbent with thermoplastic resin or above ionizing radiation curable resin. To be more specific, there is available a resin wherein reactive group such as addition polymerizing double bond (for example, vinyl group, acryloyl group, and methacryloyl group), alcohol type hydroxyl group, amino group, carboxyl group, epoxy group, and isocyanate group is adopted to known non-reactive organic ultraviolet absorbent of salicylate type, benzo phenon type, benzo triazole type, substituted acrylonitrile type, nickel chelate type, or hindered amine type.

In the present invention, the transferable protection layer is formed on the support for example in the following process: necessary additives such as antistatic agent and wax are added to synthetic resin to produce solution for coating, and the release layer already formed on the support is coated with this solution by a known means such as photochemical gravure coating process, photogravure reverse coating process or roll coating process, and then dried. The thickness of the formed transferable protection layer is about 0.5–5 μm, preferably about 1–2 μm.

[Release Layer]

It is preferable that the detachable transferable protection layer of the present invention is provided on the support via a non-transferable release layer.

For the purpose that the adhesion between the support and non-transferable release layer is always greater enough than the adhesion between non-transferable release layer and transferable protection layer and also the adhesion between the non-transferable release layer and transferable protection layer before heat is applied is greater than that after heat is applied, it is preferable that the non-transferable release layer: (1) contains not only resin binder but also 30–80% by weight of inorganic particles having the mean particle size of not more than 40 nm, or (2) contains total 20% by weight or more of alkyl vinyl ether/maleic anhydride copolymer, its derivative, or their mixture, or (3) contains 20% by weight or more of Ionomer. Other additives may be added to the non-transferable release layer as needed.

Inorganic particle may be for example silica particle such as silica anhydride and colloidal silica, and metal oxide such as tin oxide, zinc oxide, and zinc antimonite. The particle size of the inorganic particle is preferably not more than 40 nm. Mean particle size in excess of 40 nm is not favorable because the surface unevenness of the transferable protection layer becomes remarkable due to the surface unevenness of the release layer, resulting in lower transparency of the transferable protection layer.

There is no limitation to the resin to be mixed with the inorganic particle, and any mixable resin is applicable. For example, polyvinyl alcohol resin (PVA), polyvinyl acetal resin, polyvinyl butyral resin, acrylic resin, polyamide type resin, cellulose type resin such as cellulose acetate, alkyl cellulose, carboxy methyl cellulose, and hydroxy alkyl cellulose, polyvinyl pyrrolidone resin of different degree of saponification are applicable.

The mixture ratio of inorganic particle to other mixed components mainly comprising resin binder (organic particle/other mixed components) is preferably not less than 30/70 by weight but not more than 80/20. If the ratio is not more than 30/70, the effect of using inorganic particle turns to be insufficient. On the other hand, if it exceeds 80/20, the release layer cannot be formed into a complete film and consequently the support may contact directly with the transferable protection layer from place to place.

Examples of alkyl vinyl ether/maleic anhydride copolymer or its derivative include, for example (i) one wherein alkyl group of the alkyl vinyl ether portion is methyl group or ethyl group; or (ii) one wherein the maleic anhydride portion is partly or completely half-esterified with alcohol (for example, methanol, ethanol, propanol, isopropanol, butanol, and isobutanol).

The release layer may be made only by using alkyl vinyl ether/maleic anhydride copolymer, its derivative, or their mixture, but other resin or microparticle may be added so as to adjust the separation force between the release layer and transferable protection layer. When this applies, the content of alkyl vinyl ether/maleic anhydride copolymer, its derivative, or their mixture is preferably not less than 20% by weight. If the content is less than 20 wt. %, the effect of using alkyl vinyl ether/maleic anhydride copolymer, its derivative, or their mixture turns to be insufficient.

Resin or particle to be mixed with alkyl vinyl ether/maleic anhydride copolymer or its derivative may be any material without limitation so far as it is mixable and high transparency may be achieved when it is formed into film. For example, the aforementioned inorganic microparticles and resin binder that may be mixed with inorganic microparticle are preferable.

Ionomer may be for example Sahrine A (manufactured by Dupont Japan, Ltd.) or Chemiparl S Series (Manufactured by Mitsui Petrochemicals Co., Ltd.). In addition, the aforementioned inorganic microparticles, resin binder that may be mixed with inorganic microparticle, or other resin and microparticle may be added to Ionomer.

The non-transferable release layer may be formed in the following process: coating solution containing one of the above components (1) to (3) at a specified ratio is prepared, and the support is coated with this solution by a known technique such as photochemical gravure coating process or photogravure reverse coating process, and then dried. The thickness of the non-transferable release layer is about 0.1–2 μm after drying.

The protection layer to be laminated on the support via or without the non-transferable release layer may be of multi-layer structure or single-layer structure. If a multi-layer structure is employed, in addition to the main transferable protection layer which adds various kinds of durability to the image, following layers may be further provided: (i) an adhesion layer provided on the top surface of the transferable protection layer for increasing the adhesion between the transferable protection layer and the surface of the image receiving layer, (ii) supplementary transferable protection layer and (iii) layers for adding other functions which is not intended by the transferable protection layer (forgery protection layer and hologram layer, for example). Sequence of laminating the main transferable protection layer and other layers is optional but these other layers are generally laminated between the adhesion layer and main transferable protection layer so that the main transferable protection layer appears on the top surface of the image receiving surface after transferred.

[Adhesion Layer]

It is preferable that the adhesion layer is formed on the top surface of the transferable protection layer. The adhesion layer may be made of resin that exhibits excellent adhesion under heat, which may be for example acrylic resin, vinyl chloride type resin, vinyl acetate type resin, vinyl chloride/vinyl acetate copolymer resin, polyester type resin, and polyamide type resin. Furthermore, the above-mentioned ionizing radiation curable resin or ultraviolet blocking resin may also be added as needed. The thickness of the adhesion layer is normally 0.1–5 μm.

The transferable protection layer may be formed on the non-transferable release layer or support for example in the following manner: transferable protection layer coating solution containing the resin for forming the transferable protection layer, adhesion layer coating solution containing the thermo-adhesive resin, and coating solution for forming other layers to be added as needed are prepared, and the non-transferable release layer or support is coated with these solutions in a specified lamination sequence and dried. These solutions may be applied by a known coating process. In addition, a suitable primer layer may be provided between each layer.

[Others]

<UV Absorbent>

It is preferable that at least one layer of the transferable protection layer unit (release layer, transferable protection layer and adhesion layer) contains ultraviolet absorbent. If a transparent resin layer is impregnated with the absorbent, however, because the transparent resin layer appears on the top surface of the image receiving sheet after the transferable protection layer is transferred, it is affected by environment in a long run and accordingly its effect deteriorates by time. Hence, it is specifically preferable to impregnate the thermal adhesion layer with the absorbent.

Ultraviolet absorbent may be, for example, salicylate type, benzo phenon type, benzo triazole type, and cyano acrylate type. Te be concrete, any of the following products commercially available in the market is applicable to the present invention: Tinuvin P, Tinuvin 234, Tinuvin 320, Tinuvin 326, Tinuvin 327, Tinuvin 328, Tinuvin 312, and Tinuvin 315 (manufactured by Chiba-Geigy Japan Ltd.), and Sumisorb-110, Sumisorb-130, Sumisorb-140, Sumisorb-200, Sumisorb-250, Sumisorb-300, Sumisorb-320, Sumisorb-340, Sumisorb-350, and Sumisorb-400 (manufactured by Sumitomo Chemical Co., Ltd.), and Mark LA-32, Mark LA-36, and Mark 1413 (manufactured by ADEKA Argus Co., Ltd.).

It is also possible to use random copolymer with Tg of not lower than 60° C., preferably not lower than 80° C., wherein reactive ultraviolet absorbent and acrylic monomer are random-copolymerized.

The above ultraviolet absorbent may be, for example, made of known non-reactive ultraviolet absorbent such as salicylate type, benzo phenon type, benzo triazole type, substituted acrylonitrile type, nickel chelate type, and hindered amine type to which addition polymerizing double bond such as vinyl group, acryloyl group, and methacryloyl group or alcohol type hydroxyl group, amino group, carboxyl group, epoxy group, and isocyanate group is adopted. To be concrete, these are commercially available in the market under the product name of UVA635L and UVA633L (manufactured by BASF Japan Co., Ltd.), PUVA-30M (manufactured by Otsuka Chemical Co., Ltd.) etc., and any of them is applicable to the present invention.

The amount of reactive ultraviolet absorbent in the random copolymer of reactive ultraviolet absorbent and acrylic monomer is in a range of 10–90% by weight, preferably in a range of 30–70% by weight. The molecular weight of the random copolymer may be about 5,000–250,000, preferably from about 9,000–30,000. The above-mentioned ultraviolet absorbent and random copolymer of reactive ultraviolet absorbent and acrylic monomer may be added independently or both together. Preferable amount of the random copolymer of reactive ultraviolet absorbent and acrylic monomer to be added is in a range of 5–50% by weight of the layer to be impregnated.

<Light Resisting Agent>

Naturally, other light resisting agent besides the ultraviolet absorbent may also be added. Light resisting agent means a chemical that absorbs or isolates an effect such as light energy, heat energy or oxidation which deforms or decomposes the dye and prevents deformation or decomposition of the dye. To be concrete, not only the above-mentioned ultraviolet absorbent but also other additives such as antioxidant and light stabilizer which are used as additives for synthetic resins are included. If any is employed, it may be added to at least one of the layers in the transferable protection layers, that is, at least one of the above-mentioned release layer, transparent resin layer and thermal adhesion layer. Adding it to the thermal adhesion layer is specifically preferable.

<Antioxidant>

Antioxidant may be primary antioxidant such as phenol type, monophenol type, bisphenol type, and amine type, and secondary antioxidant such as sulfur type and phosphorus type. Light stabilizer may be hindered amine type. The amount of light resisting agent, including the above ultraviolet absorbent, to be added may be any without limitation, but 0.05–10 weight parts are preferable and 3 –10 weight parts are specifically preferable compared to 100 weight parts of the resin for forming the layer to be impregnated with the agent. If the amount is too small, sufficient light resisting effect cannot be produced and use of too much amount is not economical.

Besides the above light resisting agent, an appropriate amount of other additives such as fluorescent whitener and filler may be added to the adhesion layer.

The transparent resin layer in the transferable protection layer of the transfer sheet may be provided alone on the support or alternately with the ink layers on the thermal transfer sheet.

[Heat Resisting Lubrication Layer]

On the thermal transfer sheet of the present invention, it is preferable to provide a heat resisting lubrication layer on the other side of the support opposite to the dye layer side.

The heat resisting lubrication layer is provided so as to prevent thermal fusion between the heating device such as thermal head and support to facilitate smooth conveyance and also to remove foreign substance collected on the thermal head.

Resin used for this heat resisting lubrication layer may be natural or synthetic resin, alone or in mixture, including cellulose type resin such as ethyl cellulose, hydroxy cellulose, hydroxy propyl cellulose, methyl cellulose, cellulose acetate, cellulose acetate butyrate, and nitro cellulose, vinyl type resin such as polyvinyl alcohol, polyvinyl acetate, polyvinyl butyral, polyvinyl acetal, and polyvinyl pyrrolidone, acrylic resin such as polymethacrylic acid methyl, polyacrylic acid ethyl, polyacrylic amide, and acrylonitrile—styrene copolymer, polyimide resin, polyamide resin, polyamide imide resin, polyvinyl toluene resin, coumarone-indene resin, polyester type resin, and polyurethane resin, silicone modified or fluorine modified urethane. In order to increase the heat resistance of the heat resisting lubrication layer, it is preferable to select a resin containing hydroxyl type reactive group among the above resins and to use polyisocyanate as crosslinking agent to form a crosslinked resin layer.

In order to allow smooth sliding of the thermal head, solid or liquid release agent or lubricant may be added to the heat resisting lubrication layer so as to add heat resisting lubrication. Examples of release agents or lubricants to be added include, for example various types of wax such as polyethylene wax and paraffin wax, and organic compound particle such as higher fatty alcohol, organo polysiloxyane, anionic surface active agent, cationic surface active agent, amphoteric surface active agent, nonionic surface active agent, fluorocarbon surface active agent, metal ion, organic carbonic acid and its derivative, fluoro resin, silicone type resin, talc, and silica. The amount of lubricant to be added to the heat resisting lubrication layer shall be about 5–50% by weight, preferably about 10–30% by weight. The thickness of this heat resisting lubrication layer is about 0.1–10 μm, and is preferably 0.3–5 μm.

If the transferable protection layer unit is a laminate of the transferable protection layer and adhesion layer, the adhesion layer functions to allow smooth transfer of the transferable protection layer onto the image receiving sheet. Examples of adhesives used for this adhesion layer include, thermo-fusible adhesive such as acryl, styrene acryl, vinyl chloride, styrene—vinyl chloride—vinyl acetate copolymer, and vinyl chloride—vinyl acetate copolymer. Adhesive layer may be formed by a known means such as photochemical gravure coating process, photochemical gravure reverse coating process and roll coating process. Preferable thickness is about 0.1–5 μm.

[Method of Forming an Image]

Figure 4:
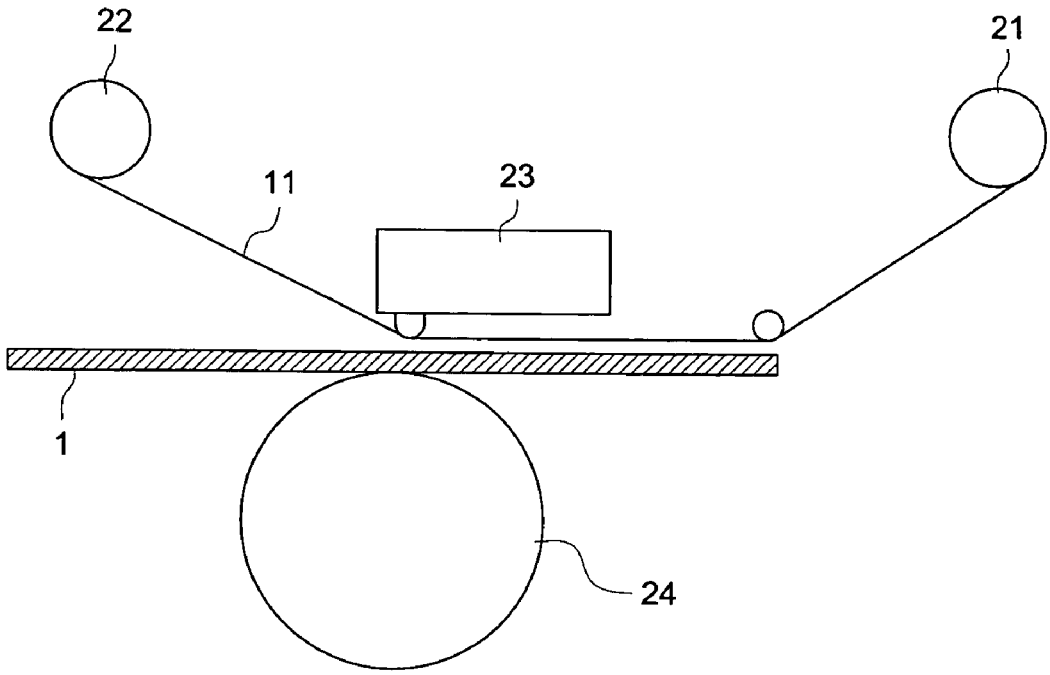
FIG. 4 is a diagram showing a typical example of a thermal transfer recording unit used in the method of forming an image of the present invention.

A thermal transfer recording unit shown in FIG. 4 is used in the method of forming an image of the present invention. In FIG. 4, 21 is a supply roll of the thermal transfer sheet, 11 is the thermal transfer sheet, 22 is a take-up roll for taking up the used thermal transfer sheet 11, 23 is the thermal head, 24 is a platen roller, and 1 is the thermal transfer image receiving sheet placed between the thermal head 23 and platen roller 24.

A process of forming an image, using the thermal transfer sheet shown in FIG. 3, with the thermal transfer recording unit shown in FIG. 4 is described hereunder. To start with, the dye layer 13Y of the thermal transfer sheet in FIG. 3, containing yellow dye, is put together with the image receiving layer of the thermal transfer image receiving sheet. By the heat applied by the thermal head 23, the yellow dye in the dye layer 13Y is transferred onto the image receiving sheet according to image data so as to form a yellow image. Next, magenta dye is transferred over the yellow image from the dye layer 13M containing magenta dye so as to form an image in the same process as above, and then cyan dye is transferred over the above transferred image from the dye layer 13C containing cyan dye so as to form an image in the same process as above. Finally, the transferable protection layer unit 14 containing a transferable protection layer is thermally transferred from the thermal transfer sheet over the entire surface of the above image, and forming the image is now completed.

For the thermal transfer recording unit used in the present invention, it is preferable if control of glossiness and mat is selectable in one unit because prints of desired surface touch may be attained with a single unit. Selection method is not specifically limited. For example, control data of the present invention corresponding to glossiness and mat may be stored in the thermal transfer recording unit so that the control data is read out by a simple operation by operator and controller of the unit is controlled according to the control data. If a personal computer is hooked with the recording unit, control data may be stored in the computer so that selected control data is sent to the recording unit by a simple operation by operator. If a process of heating a print by hot roller is employed, material that deforms the surface quality, for example a release sheet that adds to glossiness or sheet with uneven surface that produces mat touch, is put over the image receiving layer surface and heat is applied from the back of the sheet by the hot roller. Thus, recorded print with different surface touch is attained.

EXAMPLES

Concrete examples of the present invention are described hereunder but the invention is not limited thereto.

Example 1

<<Production of Thermal Transfer Image Receiving Sheet>>

[Production of Thermal Transfer Image Receiving Sheet 1]

A corona discharge treatment was applied to one side of coat paper (basis weight 157 g/m$^2$, OK Top Coat S manufactured by Oji Paper Co., Ltd.). Then, as backing resin layers, high-density polyethylene (hereinafter called HDPE) [Jeyrex LZ0139-2, density 0.952, manufactured by Nippon Polyolefin Co., Ltd.] blended with 15% by weight of ethylene-α-olefin copolymer [Tafiner A-4085 manufactured by Mitsui Chemical Co., Ltd.] and polypropylene (hereinafter called PP) [Jeyaromer LR711-5, density 0.905, manufactured by Nippon Polyolefin Co., Ltd.] were extruded into two layers by the well-known co-extrusion coating method using a multilayer T-die so that the HDPE layer side contacted the corona discharge treated surface of the coat paper. Extrusion quantity was adjusted so that the thickness of the backing resin layer became 14 μm for the ethylene-α-olefin copolymer blended HDPE layer and 19 μm for the PP layer.

Then, after a corona discharge treatment was applied on the PP layer surface which appears outside, backing layer coating solution 1 having the following composition was applied to the surface so that dried solid weight was 1.5 g/m$^2$. Thus, a support made from coat paper was produced.

| <Backing layer coating solution 1> | |
|---|---|
| Acrylic resin (BR-85 manufactured by Mitsubishi Rayon Co., Ltd.) | 19.8 weight parts |
| Nylon filler (MW-330 manufactured by Shinto Paint Co., Ltd.) | 0.6 weight parts |
| Methyl ethyl ketone | 39.8 weight parts |
| Toluene | 39.8 weight parts |

Next, on one side of foamed polypropylene sheet (35MW846 manufactured by Mobil Plastics Europe Co., Ltd.) of 35 μm thick having micro voids, intermediate layer coating solution 1 having the composition as shown in Table 1 and the following image receiving layer coating solution 1 were applied one after another by the photochemical gravure reverse coating process and dried so that the dried film thickness was 1.0 μm (intermediate layer) and 3.0 μm (image receiving layer). Thus, foamed polypropylene sheet laminated with the intermediate layer and image receiving layer was produced.

Next, the other side of the foamed polypropylene sheet opposite to the intermediate layer and image receiving layer side was adhered with the other side of the above coat paper support 1 opposite to the backing layer side by the dry lamination process using the adhesive of the following composition. Thus, the thermal transfer image receiving sheet 1 was produced. For reference sake, specific gravity of each urethane type resin (Nippolan 5199 manufactured by Nippon Polyurethane Industry Co., Ltd.), antistatic agent SN-100P (manufactured by Ishihara Techno Corp.) and polyester resin (Byron 245 manufactured by TOYOBO Co., Ltd.) were measured and the results were 1.2, 6.6 and 1.4 g/cm$^3$, respectively.

| (Image receiving sheet coating solution 1) | |
|---|---|
| Vinyl chloride - vinyl acetate copolymer (DENKA Vinyl #1000A manufactured by Denki Kagaku Kogyo Co., Ltd.) | 7.2 weight parts |
| Vinyl chloride - styrene - acryl copolymer (DENKA Lac #400 manufactured by Denki Kagaku Kogyo Co., Ltd.) | 1.6 weight parts |
| Polyester (Byron 600 manufactured by TOYOBO Co., Ltd.) | 11.2 weight parts |
| Compound containing metal ion: MS-1 (*1) | 3 weight parts |
| Vinyl modified silicone (X-62-1212 manufactured by Shin-Etsu Chemical Co., Ltd.) | 2.0 weight parts |
| Catalyst: CAT PLR-5 (manufactured by Shin-Etsu Chemical Co., Ltd.) | 1.0 weight parts |
| Catalyst: CAT PL-50T (manufactured by Shin-Etsu Chemical Co., Ltd.) | 1.2 weight parts |
| Solvent: methyl ethyl ketone | 39.0 weight parts |
| Solvent: toluene | 39.0 weight parts |
| (Adhesive) | |
| Multifunctional polyole (Takelac A-969V manufactured by Takeda Pharmaceutical Co., Ltd.) | 30.0 weight parts |
| Isocyanate (Takenate A-5 manufactured by Takeda Pharmaceutical Co., Ltd.) | 10.0 weight parts |
| Solvent: ethyl acetate | 60.0 weight parts |

(*1) MS-1: $Ni^{2+}$ $[C_7H_{15}COC(COOCH_3){=}C(CH_3)O^-]_2$

[Production of Thermal Transfer Image Receiving Sheets 2 to 18]

Thermal transfer image receiving sheets 2 to 18 were produced in the same manner as in the production of the thermal transfer image receiving sheet 1 except that the intermediate layer coating solution 1 was replaced with intermediate layer coating solutions 2 to 18 respectively.

Table 1 shows the composition of each intermediate layer coating solution used with the thermal transfer image receiving sheets 1 to 18 produced as above and the volume ratio of antistatic agent to the total solid volume of the intermediate layer.

Detail of each additive listed in Table 1 is as follows.

Urethane type resin: Nippolan 5199 manufactured by Nippon Polyurethane Industry Co., Ltd., solid content 30 wt. %

Polyester resin: Byron 245 manufactured by TOYOBO Co., Ltd.

Antistatic agent: SN-100P manufactured by Ishihara Techno Corp.

Titanium oxide: TCA888TC manufactured by Tohkem Co., Ltd.

Fluorescent whitener: Ubitex OB manufactured by Ciba-Geigy Japan Ltd.

Isocyanate: Takenate A-14 manufactured by Takeda Pharmaceutical Co., Ltd.

Solvent 1: methyl ethyl ketone

Solvent 2: acetone

Solvent 3: isopropyl alcohol

| | |
|---|---|
| (Backing layer coating solution 2: for thermal transfer image receiving sheet 19) | |
| Cellulose acetate (CA398-10 manufactured by Eastman Chemical Japan Co., Ltd.) | 10 weight parts |
| Nylon filler (MW-330 manufactured by Shinto Paint Co., Ltd.) | 0.5 weight parts |
| Acetone | 200 weight parts |
| Cyclohexane | 20 weight parts |
| (Backing layer coating solution 3: for thermal transfer image receiving sheet 20) | |
| Cellulose acetate butyrate (CAB381-20 manufactured by Eastman Chemical Japan Co., Ltd.) | 10 weight parts |
| Nylon filler (MW-330 manufactured by Shinto Paint Co., Ltd.) | 0.5 weight parts |
| Acetone | 200 weight parts |
| Cyclohexane | 20 weight parts |
| (Backing layer coating solution 4: for thermal transfer image receiving sheet 21) | |
| Cellulose acetate propionate (CAP482-20 manufactured by Eastman Chemical Japan Co., Ltd.) | 10 weight parts |
| Nylon filler (MW-330 manufactured by Shinto Paint Co., Ltd.) | 0.5 weight parts |
| Acetone | 200 weight parts |
| Cyclohexane | 20 weight parts |

TABLE 1

| Thermal transfer image receiving sheet No. | Composition of solution for intermediate layer impregnation (by weight) | | | | | | | | | | | |
|---|---|---|---|---|---|---|---|---|---|---|---|---|
| | | | | Antistatic agent | | | | | | | | |
| | No. | Urethane type resin | Polyester resin | Amount added | Volume ratio (%) | Titanium oxide | Fluorescent whitener | Isocyanate | Solvent 1 | Solvent 2 | Solvent 3 | Remarks |
| 1 | 1 | 1.73 | — | 3.2 | 25 | 11.4 | 0.2 | 2.0 | 15.5 | 15.5 | 7.7 | Inv. |
| 2 | 2 | 1.73 | — | 4.0 | 30 | 11.4 | 0.2 | 2.0 | 15.5 | 15.5 | 7.7 | Inv. |
| 3 | 3 | 1.73 | — | 5.1 | 35 | 11.4 | 0.2 | 2.0 | 15.5 | 15.5 | 7.7 | Inv. |
| 4 | 4 | 1.73 | — | 9.4 | 50 | 11.4 | 0.2 | 2.0 | 15.5 | 15.5 | 7.7 | Inv. |
| 5 | 5 | 1.73 | — | 22.0 | 75 | 11.4 | 0.2 | 2.0 | 15.5 | 15.5 | 7.7 | Inv. |
| 6 | 6 | 1.73 | — | 28.2 | 75 | 11.4 | 0.2 | 2.0 | 15.5 | 15.5 | 7.7 | Inv. |
| 7 | 7 | 1.73 | — | 37.6 | 80 | 11.4 | 0.2 | 2.0 | 15.5 | 15.5 | 7.7 | Inv. |
| 8 | 8 | — | 1.71 | 2.7 | 25 | 11.4 | 0.2 | 2.0 | 15.5 | 15.5 | 7.7 | Inv. |
| 9 | 9 | — | 1.71 | 3.5 | 30 | 11.4 | 0.2 | 2.0 | 15.5 | 15.5 | 7.7 | Inv. |
| 10 | 10 | — | 1.71 | 4.4 | 35 | 11.4 | 0.2 | 2.0 | 15.5 | 15.5 | 7.7 | Inv. |
| 11 | 11 | — | 1.71 | 8.1 | 50 | 11.4 | 0.2 | 2.0 | 15.5 | 15.5 | 7.7 | Inv. |
| 12 | 12 | — | 1.71 | 18.8 | 75 | 11.4 | 0.2 | 2.0 | 15.5 | 15.5 | 7.7 | Inv. |
| 13 | 13 | — | 1.71 | 24.2 | 75 | 11.4 | 0.2 | 2.0 | 15.5 | 15.5 | 7.7 | Inv. |
| 14 | 14 | — | 1.71 | 32.1 | 80 | 11.4 | 0.2 | 2.0 | 15.5 | 15.5 | 7.7 | Inv. |
| 15 | 15 | 1.73 | — | 2.64 | 22 | 11.4 | 0.2 | 2.0 | 15.5 | 15.5 | 7.7 | Comp. |
| 16 | 16 | 1.73 | — | 45.6 | 83 | 11.4 | 0.2 | 2.0 | 15.5 | 15.5 | 7.7 | Comp. |
| 17 | 17 | — | 1.71 | 2.28 | 22 | 11.4 | 0.2 | 2.0 | 15.5 | 15.5 | 7.7 | Comp. |
| 18 | 18 | — | 1.71 | 39.3 | 83 | 11.4 | 0.2 | 2.0 | 15.5 | 15.5 | 7.7 | Comp. |

Inv.: This invention
Comp.: Comparative sample

[Production of Thermal Transfer Image Receiving Sheets 19 to 21]

Thermal transfer image receiving sheets 19 to 21 were produced in the same manner as in the production of the thermal transfer image receiving-sheet 4 except that the backing layer coating solution 1 used on the support 1 was replaced with the following backing layer coating solutions 2, 3 and 4, which were then applied to form cellulose type backing layer on supports 2, 3 and 4 and dried so that each solid content after drying became 1.5 g/m$^2$.

[Production of Thermal Transfer Image Receiving Sheet 22]

Thermal transfer image receiving sheet 22 was produced in the same manner as in the production of the thermal transfer image receiving sheet 19 except that the intermediate layer coating solution 4 was replaced with intermediate layer coating solutions 19 having the following composition and also the image receiving layer coating solution 1 was change to image receiving layer coating solution 2 having the following composition. For reference sake, specific gravity of the mixture of DENKA Vinyl #1000A (manufactured by Denki Kagaku Kogyo Co., Ltd.)/DENKA Lac #400 (manufactured by Denki Kagaku Kogyo Co., Ltd.)/Byron 600 (manufactured by TOYOBO Co., Ltd.) of 7.2 weight parts/1.6 weight parts/11.2 weight parts used for the image receiving sheet 2 was measured and the result was 1.3 g/m$^3$.

| (Intermediate layer coating solution 19) | |
|---|---|
| Urethane type resin (Nippolan 5199 manufactured by Nippon Polyurethane Industry Co., Ltd.) | 5.7 weight parts |
| Titanium oxide (TCA888 manufactured by Tohkem Co., Ltd.) | 11.4 weight parts |
| Fluorescent whitener (Ubitex OB manufactured by Ciba-Geigy Japan Ltd.) | 0.2 weight parts |
| Isocyanate (Takenate A-14 manufactured by Takeda Pharmaceutical Co., Ltd.) | 2.0 weight parts |
| Methyl ethyl ketone | 15.5 weight parts |
| Toluene | 15.5 weight parts |
| Isopropyl alcohol | 7.7 weight parts |
| (Image receiving layer coating solution 2) | |
| Vinyl chloride - vinyl acetate copolymer (DENKA Vinyl #1000A manufactured by Denki Kagaku Kogyo Co., Ltd.) | 7.2 weight parts |
| Vinyl chloride - styrene - acryl copolymer (DENKA Lac #400 manufactured by Denki Kagaku Kogyo Co., Ltd.) | 1.6 weight parts |
| Polyester (Byron 600 manufactured by TOYOBO Co., Ltd.) | 11.2 weight parts |
| MS-1 (afore-mentioned) | 3 weight parts |
| Antistatic agent (SN-100P manufactured by Ishihara Techno Corp.) | 54.7 weight parts |
| Vinyl modified silicone (X-62-1212 manufactured by Shin-Etsu Chemical Co., Ltd.) | 2.0 weight parts |
| Catalyst (CAT PLR-5 manufactured by Shin-Etsu Chemical Co., Ltd.) | 1.0 weight parts |
| Catalyst (CAT PL-50T (manufactured by Shin-Etsu Chemical Co., Ltd.) | 1.2 weight parts |
| Methyl ethyl ketone | 39.0 weight parts |
| Toluene | 39.0 weight parts |

[Production of Thermal Transfer Image Receiving Sheet 23]

Thermal transfer image receiving sheet 23 was produced in the same manner as in the production of the thermal transfer image receiving sheet 19 except that, after the intermediate layer coating solution 4 was applied on the foamed polypropylene sheet, a secondary intermediate layer having the following composition was put on it so that its dried thickness was 0.5 μm, and then the image receiving layer coating solution 2 was laminated over it.

| (Secondary intermediate layer coating solution) | |
|---|---|
| Urethane type resin (Nippolan 5199 manufactured by Nippon Polyurethane Industry Co., Ltd.) | 10 weight parts |
| Antistatic agent (SN-100P manufactured by Ishihara Techno Corp.) | 16.5 weight parts |
| Methyl ethyl ketone | 10 weight parts |
| Toluene | 10 weight parts |
| Isopropyl alcohol | 5 weight parts |

[Production of Thermal Transfer Image Receiving Sheets 24 and 25]

Thermal transfer image receiving sheets 24 and 25 were produced in the same manner as in the production of the thermal transfer image receiving sheets 3 and 4 except that the following intermediate layer coating solutions 20 and 21, for which the antistatic agent (SN-100P manufactured by Ishihara Techno Corp.) used in the previous intermediate coating solution was replaced with an antistatic (FS-10P manufactured by Ishihara Techno Corp.) of the same amount, were used.

| (Intermediate layer coating solution 20) | |
|---|---|
| Urethane type resin (Nippolan 5199 manufactured by Nippon Polyurethane Industry Co., Ltd.) | 5.7 weight parts |
| Antistatic agent (FS-10P manufactured by Ishihara Techno Corp.) | 5.1 weight parts |
| Titanium oxide (TCA888 manufactured by Tohkem Co., Ltd.) | 11.4 weight parts |
| Fluorescent whitener (Ubitex OB manufactured by Ciba-Geigy Japan Ltd.) | 0.2 weight parts |
| Isocyanate (Takenate A-14 manufactured by Takeda Pharmaceutical Co., Ltd.) | 2.0 weight parts |
| Methyl ethyl ketone | 15.5 weight parts |
| Toluene | 15.5 weight parts |
| Isopropyl alcohol | 7.7 weight parts |
| (Intermediate layer coating solution 21) | |
| Urethane type resin (Nippolan 5199 manufactured by Nippon Polyurethane Industry Co., Ltd.) | 5.7 weight parts |
| Antistatic agent (FS-10P manufactured by Ishihara Techno Corp.) | 9.4 weight parts |
| Titanium oxide (TCA888 manufactured by Tohkem Co., Ltd.) | 11.4 weight parts |
| Fluorescent whitener (Ubitex OB manufactured by Ciba-Geigy Japan Ltd.) | 0.2 weight parts |
| Isocyanate (Takenate A-14 manufactured by Takeda Pharmaceutical Co., Ltd.) | 2.0 weight parts |
| Methyl ethyl ketone | 15.5 weight parts |
| Toluene | 15.5 weight parts |
| Isopropyl alcohol | 7.7 weight parts |

[Production of Thermal Transfer Image Receiving Sheet 26]

Thermal transfer image receiving sheet 26 was produced in the same manner as in the production of the thermal transfer image receiving sheet 19 except that the intermediate layer coating solution 4 was replaced with the above intermediate solution 21.

[Production of Thermal Transfer Image Receiving Sheet 27]

Thermal transfer image receiving sheet 27 was produced in the same manner as in the production of the thermal transfer image receiving sheet 26 except that the intermediate layer coating solution 21 was replaced with intermediate solution 22 having the following composition. For reference sake, specific gravity of the antistatic agent ET-600W (manufactured by Ishihara Techno Corp.) was measured and the result was 4.5 g/m$^3$.

| (Intermediate layer coating solution 22) | |
|---|---|
| Urethane type resin (Nippolan 5199 manufactured by Nippon Polyurethane Industry Co., Ltd., solid content 30%) | 5.7 weight parts |
| Antistatic agent (ET-600W manufactured by Ishihara Techno Corp.) | 5.25 weight parts |
| Titanium oxide (TCA888 manufactured by Tohkem Co., Ltd.) | 11.4 weight parts |
| Fluorescent whitener (Ubitex OB manufactured by Ciba-Geigy Japan Ltd.) | 0.2 weight parts |
| Isocyanate (Takenate A-14 manufactured by Takeda Pharmaceutical Co., Ltd.) | 2.0 weight parts |

-continued

| (Intermediate layer coating solution 22) | |
|---|---|
| Methyl ethyl ketone | 15.5 weight parts |
| Toluene | 15.5 weight parts |
| Isopropyl alcohol | 7.7 weight parts |

[Production of Thermal Transfer Image Receiving Sheet 28]

Thermal transfer image receiving sheet 28 was produced in the same manner as in the production of the thermal transfer image receiving sheet 27 except that the support 2 was replaced with support 4 and also the intermediate layer coating solution 22 was replaced with intermediate solution 23 having the following composition.

| (Intermediate layer coating solution 23) | |
|---|---|
| Urethane type resin (Nippolan 5199 manufactured by Nippon Polyurethane Industry Co., Ltd., solid content 30%) | 5.7 weight parts |
| Antistatic agent (FT-3000 manufactured by Ishihara Techno Corp.) | 5.13 weight parts |
| Titanium oxide (TCA888 manufactured by Tohkem Co., Ltd.) | 11.4 weight parts |
| Fluorescent whitener (Ubitex OB manufactured by Ciba-Geigy Japan Ltd.) | 0.2 weight parts |
| Isocyanate (Takenate A-14 manufactured by Takeda Pharmaceutical Co., Ltd.) | 2.0 weight parts |
| Methyl ethyl ketone | 15.5 weight parts |
| Toluene | 15.5 weight parts |
| Isopropyl alcohol | 7.7 weight parts |

[Production of Thermal Transfer Image Receiving Sheet 29]

Thermal transfer image receiving sheet 29 was produced in the same manner as in the production of the thermal transfer image receiving sheet 26 except that the intermediate layer coating solution 21 was replaced with intermediate layer coating solution 24 having the following composition. For reference sake, specific gravity of the antistatic agent Laponite JS (manufactured by Nihon (Tosoh) Silica Corp.) was measured and the result was 0.91 g/m$^3$.

| (Intermediate layer coating solution 24) | |
|---|---|
| Urethane type resin (Nippolan 5199 manufactured by Nippon Polyurethane Industry Co., Ltd., solid content 30%) | 5.7 weight parts |
| Antistatic agent (Laponite JS manufactured by Nihon Silica Corp.) | 1.07 weight parts |
| Titanium oxide (TCA888 manufactured by Tohkem Co., Ltd.) | 11.4 weight parts |
| Fluorescent whitener (Ubitex OB manufactured by Ciba-Geigy Japan Ltd.) | 0.2 weight parts |
| Isocyanate (Takenate A-14 manufactured by Takeda Pharmaceutical Co., Ltd.) | 2.0 weight parts |
| Methyl ethyl ketone | 15.5 weight parts |
| Toluene | 15.5 weight parts |
| Isopropyl alcohol | 7.7 weight parts |

[Production of Thermal Transfer Image Receiving Sheet 30]

Thermal transfer image receiving sheet 30 was produced in the same manner as in the production of the thermal transfer image receiving sheet 22 except that the support 2 was replaced with support 1 and also the image receiving layer coating solution 2 was replaced with image receiving layer coating solution 3 having the following composition.

| (Image receiving layer coating solution 3) | |
|---|---|
| Vinyl chloride - vinyl acetate copolymer (DENKA Vinyl #1000A manufactured by Denki Kagaku Kogyo Co., Ltd.) | 7.2 weight parts |
| Vinyl chloride - styrene - acryl copolymer (DENKA Lac #400 manufactured by Denki Kagaku Kogyo Co., Ltd.) | 1.6 weight parts |
| Polyester (Byron 600 manufactured by TOYOBO Co., Ltd.) | 11.2 weight parts |
| MS-1 (afore-mentioned) | 3 weight parts |
| Antistatic agent (Laponite JS manufactured by Nihon Silica Corp.) | 14 weight parts |
| Vinyl modified silicone (X-62-1212 manufactured by Shin-Etsu Chemical Co., Ltd.) | 2.0 weight parts |
| Catalyst (CAT PLR-5 manufactured by Shin-Etsu Chemical Co., Ltd.) | 1.0 weight parts |
| Catalyst (CAT PL-50T (manufactured by Shin-Etsu Chemical Co., Ltd.) | 1.2 weight parts |
| Methyl ethyl ketone | 39.0 weight parts |
| Toluene | 39.0 weight parts |

[Production of Thermal Transfer Image Receiving Sheet 31]

Thermal transfer image receiving sheet 31 was produced in the same manner as in the production of the thermal transfer image receiving sheet 1 except that the intermediate layer coating solution 1 was replaced with intermediate layer coating solution 25 having the following composition.

| (Intermediate layer coating solution 25) | |
|---|---|
| Urethane type resin (Nippolan 5199 manufactured by Nippon Polyurethane Industry Co., Ltd.) | 5.7 weight parts |
| Antistatic agent (crosslinked cation: copolymer [N-vinyl benzyl-N, N, N-trimethyl ammonium chloride-coethylene glycol diacrylate] 93:7) | 1.85 weight parts |
| Titanium oxide (TCA888 manufactured by Tohkem Co., Ltd. (Tohkemu Purodakutsu)) | 11.4 weight parts |
| Fluorescent whitener (Ubitex OB manufactured by Ciba-Geigy Japan Ltd.) | 0.2 weight parts |
| Isocyanate (Takenate A-14 manufactured by Takeda Pharmaceutical Co., Ltd.) | 2.0 weight parts |
| Methyl ethyl ketone | 15.5 weight parts |
| Toluene | 15.5 weight parts |
| Isopropyl alcohol | 7.7 weight parts |

[Production of Thermal Transfer Image Receiving Sheet 32]

Thermal transfer image receiving sheet 32 was produced in the same manner as in the production of the thermal transfer image receiving sheet 31 except that the support 1 was replaced with support 2 and also the intermediate layer coating solution 25 was replaced with intermediate layer coating solution 26 having the following composition.

| (Intermediate layer coating solution 26) | |
|---|---|
| Urethane type resin (Nippolan 5199 manufactured by Nippon Polyurethane Industry Co., Ltd.) | 5.7 weight parts |
| Antistatic agent (crosslinked cation: copolymer [N-vinyl benzyl-N, N, N-trimethyl ammonium chloride-coethylene glycol diacrylate] 93:7) | 4.32 weight parts |

-continued

| (Intermediate layer coating solution 26) | |
|---|---|
| Titanium oxide (TCA888 manufactured by Tohkem Co., Ltd. (Tohkemu Purodakutsu)) | 11.4 weight parts |
| Fluorescent whitener (Ubitex OB manufactured by Ciba-Geigy Japan Ltd.) | 0.2 weight parts |
| Isocyanate (Takenate A-14 manufactured by Takeda Pharmaceutical Co., Ltd.) | 2.0 weight parts |
| Methyl ethyl ketone | 15.5 weight parts |
| Toluene | 15.5 weight parts |
| Isopropyl alcohol | 7.7 weight parts |

[Production of Thermal Transfer Image Receiving Sheet 33]

Thermal transfer image receiving sheet 33 was produced in the same manner as in the production of the thermal transfer image receiving sheet 4 except that the image receiving layer coating solution 1 was change to image receiving layer coating solution 4 having the following composition.

| (Image receiving layer coating solution 4) | |
|---|---|
| Vinyl chloride - vinyl acetate copolymer (DENKA Vinyl #1000A manufactured by Denki Kagaku Kogyo Co., Ltd.) | 7.2 weight parts |
| Vinyl chloride - styrene - acryl copolymer (DENKA Lac #400 manufactured by Denki Kagaku Kogyo Co., Ltd.) | 1.6 weight parts |
| Polyester (Byron 600 manufactured by TOYOBO Co., Ltd.) | 11.2 weight parts |
| Vinyl modified silicone (X-62-1212 manufactured by Shin-Etsu Chemical Co., Ltd.) | 2.0 weight parts |
| Catalyst (CAT PLR-5 manufactured by Shin-Etsu Chemical Co., Ltd.) | 1.0 weight parts |
| Catalyst (CAT PL-50T manufactured by Shin-Etsu Chemical Co., Ltd.) | 1.2 weight parts |
| Solvent: methyl ethyl ketone | 39.0 weight parts |
| Solvent: toluene | 39.0 weight parts |

[Production of Thermal Transfer Image Receiving Sheet 34: Comparative Sample]

Thermal transfer image receiving sheet 34 was produced in the same manner as in the production of the thermal transfer image receiving sheet 30 except that the image receiving layer coating solution 3 was replaced with image receiving layer coating solution 5 having the following composition.

| (Image receiving layer coating solution 5) | |
|---|---|
| Vinyl chloride - vinyl acetate copolymer (DENKA Vinyl #1000A manufactured by Denki Kagaku Kogyo Co., Ltd.) | 7.2 weight parts |
| Vinyl chloride - styrene - acryl copolymer (DENKA Lac #400 manufactured by Denki Kagaku Kogyo Co., Ltd.) | 1.6 weight parts |
| Polyester (Byron 600 manufactured by TOYOBO Co., Ltd.) | 11.2 weight parts |
| Antistatic agent (surface active agent, quaternary ammonium salt, KS-555 manufactured by KAO Corp.) | 20 weight parts |
| Vinyl modified silicone (X-62-1212 manufactured by Shin-Etsu Chemical Co., Ltd.) | 2.0 weight parts |
| Catalyst (CAT PLR-5 manufactured by Shin-Etsu Chemical Co., Ltd.) | 1.0 weight parts |
| Catalyst (CAT PL-50T manufactured by Shin-Etsu Chemical Co., Ltd.) | 1.2 weight parts |
| Methyl ethyl ketone | 39.0 weight parts |
| Toluene | 39.0 weight parts |

[Production of Thermal Transfer Image Receiving Sheet 35: Comparative Sample]

Thermal transfer image receiving sheet 35 was produced in the same manner as in the production of the thermal transfer image receiving sheet 30 except that the image receiving layer coating solution 3 was change to the aforementioned image receiving layer coating solution 1. Table 2 shows main components of the thermal transfer sheets 1 to 35 produced as above.

TABLE 2

| | Composition of thermal transfer image receiving sheet | | | | | | | | |
|---|---|---|---|---|---|---|---|---|---|
| | | Coating solution | Intermediate layer | | | Second-ary | Image receiving layer | | |
| Thermal transfer image receiving sheet | | No. for backing | Coating solution | Antistatic agent | | inter-mediate | Coating solution | Anti-static | |
| number | Support No. | layer | No. | Type | Vol. % | layer | No. | agent | Remarks |
| 1 | 1 | 1 | 1 | SN-100P | 25 | — | 1 | — | Inv. |
| 2 | 1 | 1 | 2 | SN-100P | 30 | — | 1 | — | Inv. |
| 3 | 1 | 1 | 3 | SN-100P | 35 | — | 1 | — | Inv. |
| 4 | 1 | 1 | 4 | SN-100P | 50 | — | 1 | — | Inv. |
| 5 | 1 | 1 | 5 | SN-100P | 70 | — | 1 | — | Inv. |
| 6 | 1 | 1 | 6 | SN-100P | 75 | — | 1 | — | Inv. |
| 7 | 1 | 1 | 7 | SN-100P | 80 | — | 1 | — | Inv. |
| 8 | 1 | 1 | 8 | SN-100P | 25 | — | 1 | — | Inv. |
| 9 | 1 | 1 | 9 | SN-100P | 30 | — | 1 | — | Inv. |
| 10 | 1 | 1 | 10 | SN-100P | 35 | — | 1 | — | Inv. |
| 11 | 1 | 1 | 11 | SN-100P | 50 | — | 1 | — | Inv. |
| 12 | 1 | 1 | 12 | SN-100P | 70 | — | 1 | — | Inv. |
| 13 | 1 | 1 | 13 | SN-100P | 75 | — | 1 | — | Inv. |
| 14 | 1 | 1 | 14 | SN-100P | 80 | — | 1 | — | Inv. |
| 15 | 1 | 1 | 15 | SN-100P | 22 | — | 1 | — | Comp. |

TABLE 2-continued

| Thermal transfer image receiving sheet number | Composition of thermal transfer image receiving sheet: Support No. | Coating solution No. for backing layer | Intermediate layer: Coating solution No. | Intermediate layer: Antistatic agent Type | Intermediate layer: Antistatic agent Vol. % | Secondary intermediate layer | Image receiving layer: Coating solution No. | Image receiving layer: Antistatic agent | Remarks |
|---|---|---|---|---|---|---|---|---|---|
| 16 | 1 | 1 | 16 | SN-100P | 83 | — | 1 | — | Comp. |
| 17 | 1 | 1 | 17 | SN-100P | 22 | — | 1 | — | Comp. |
| 18 | 1 | 1 | 18 | SN-100P | 83 | — | 1 | — | Comp. |
| 19 | 2 | 2 | 4 | SN-100P | 50 | — | 1 | — | Inv. |
| 20 | 3 | 3 | 4 | SN-100P | 50 | — | 1 | — | Inv. |
| 21 | 4 | 4 | 4 | SN-100P | 50 | — | 1 | — | Inv. |
| 22 | 2 | 2 | 19 | — | — | — | 2 | *1 (35) | Inv. |
| 23 | 2 | 2 | 19 | — | — | Provided (50) | 2 | — | Inv. |
| 24 | 1 | 1 | 20 | FS-10P | 35 | — | 1 | — | Inv. |
| 25 | 1 | 1 | 21 | FS-10P | 50 | — | 1 | — | Inv. |
| 26 | 2 | 2 | 21 | FS-10P | 50 | — | 1 | — | Inv. |
| 27 | 2 | 2 | 22 | ET-600W | 45 | — | 1 | — | Inv. |
| 28 | 4 | 4 | 23 | FT-3000 | 45 | — | 1 | — | Inv. |
| 29 | 2 | 2 | 24 | Laponite JS | 45 | — | 1 | — | Inv. |
| 30 | 1 | 1 | 19 | — | — | — | 3 | *2 (50) | Inv. |
| 31 | 1 | 1 | 25 | Crosslinked cation | 50 | — | 1 | — | Inv. |
| 32 | 2 | 2 | 26 | Crosslinked cation | 70 | — | 1 | | Inv. |
| 33 | 1 | 1 | 4 | SN-100P | 50 | — | 4 | — | Inv. |
| 34 | 1 | 1 | 19 | — | — | — | 5 | Surface active agent | Comp. |
| 35 | 1 | 1 | 19 | — | — | — | 1 | — | Comp. |

Figure in ( ) is vol. %.
*1: SN-100P
*2: Laponite JS
Inv.: Present invention
Comp.: Comparative sample <<Production of Thermal Transfer Sheet>>

[Production of Thermal Transfer Sheet 1]

Thermal transfer sheet 1 was produced in the following manner: each dye layer (dried film thickness of 1 μm) made from cyan dye coating solution 1, magenta dye coating solution 1, and yellow dye coating solution 1 having the following composition and multi-layered transferable protection layer unit (three-layered comprising non-transferable release layer, protection layer and adhesion layer) were placed on one side of a polyethylene terephthalate film (K-203E-6F manufactured by Diafoil Hext Co., Ltd. (Mitsubishi Polyester Film Corp.)), having a heat resisting protection layer of 6 μm thick on the other side, in series as shown in FIG. 3 by the photochemical gravure process.

| (Each dye layer) | |
|---|---|
| (Cyan dye layer coating solution 1) | |
| Post-chelate dye (C-1) | 3 weight parts |
| Polyvinyl butyral (KY-24 manufactured by Denki Kagaku Kogyo Co., Ltd.) | 5.5 weight parts |
| Urethane modified silicone resin (Daiaromer SP-2105 manufactured by Dainichiseika Color & Chemicals Mfg. Co., Ltd.) | 1.5 weight parts |
| Methyl ethyl ketone | 80 weight parts |
| Cyclohexanon | 10 weight parts |

-continued

| (Each dye layer) | |
|---|---|
| (Magenta dye layer coating solution 1) | |
| Post-chelate dye (M-1) | 3 weight parts |
| Polyvinyl butyral (KY-24 manufactured by Denki Kagaku Kogyo Co., Ltd.) | 5.5 weight parts |
| Urethane modified silicone resin (Daiaromer SP-2105 manufactured by Dainichiseika Color & Chemicals Mfg. Co., Ltd.) | 1.5 weight parts |
| Methyl ethyl ketone | 80 weight parts |
| Cyclohexanon | 10 weight parts |
| (Yellow dye layer coating solution 1) | |
| Post-chelate dye (Y-1) | 1 weight parts |
| Polyvinyl butyral (KY-24 manufactured by Denki Kagaku Kogyo Co., Ltd.) | 5.5 weight parts |
| Urethane modified silicone resin (Daiaromer SP-2105 manufactured by Dainichiseika Color & Chemicals Mfg. Co., Ltd.) | 1.5 weight parts |
| Methyl ethyl ketone | 80 weight parts |
| Cyclohexanon | 10 weight parts |

Y-1

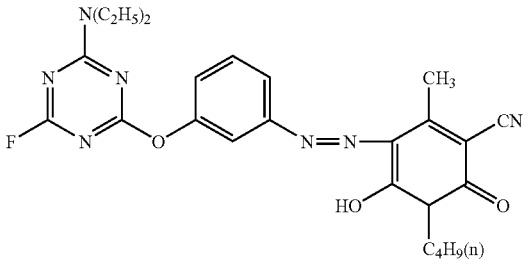

M-1

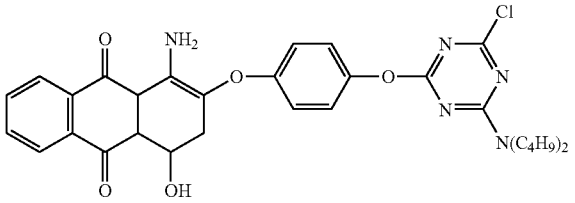

C-1

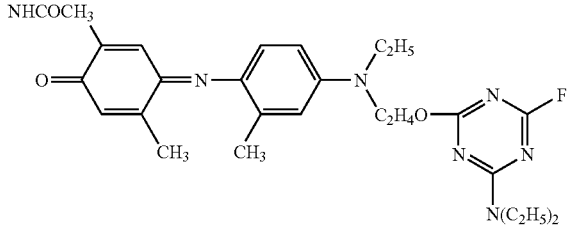

[Transferable Protection Layer Unit]

(Non-Transferable Release Layer)

Non-transferable release layer coating solution 1 having the following composition was applied by the photochemical gravure process and dried so that dried solid weight was 0.5 g/m$^2$. Thus, the non-transferable release layer was produced.

| <Non-transferable release layer coating solution 1> | |
|---|---|
| Colloidal silica (Snowtex 50 manufactured by Nissan Chemical Industries, Ltd.) | 1.5 weight parts |
| Polyvinyl alcohol | 4.0 weight parts |
| Ion exchanged water | 3.0 weight parts |
| Modified ethanol | 10 weight parts |

(Transferable Protection Layer)

Transferable protection layer coating solution 1 having the following composition was applied on the above non-transferable release layer by the photochemical gravure process and dried so that dried solid weight was 2.0 g/m$^2$. Thus, the transferable protection layer was produced.

| <Transferable protection layer coating solution 1> | |
|---|---|
| Acrylic resin | 15 weight parts |
| Vinyl chloride - vinyl acetate copolymer | 5 weight parts |
| Polystyrene wax | 0.3 weight parts |
| Polyester resin | 0.1 weight parts |

-continued

| <Transferable protection layer coating solution 1> | |
|---|---|
| Methyl ethyl ketone | 40 weight parts |
| Toluene | 40 weight parts |

(Adhesion Layer)

Adhesion layer coating solution 1 having the following composition was applied on the above transferable protection layer by the photochemical gravure process and dried so that dried solid weight was 2.0 g/m$^2$. Thus, the adhesion layer was produced.

| <Adhesion layer coating solution 1> | |
|---|---|
| Vinyl chloride - vinyl acetate copolymer | 20 weight parts |
| Methyl ethyl ketone | 100 weight parts |
| Toluene | 100 weight parts |

Thus, the multi-layered transferable protection layer in which the transferable protection layer laminated with the adhesion layer was placed on the non-transferable release layer and made detachable was produced.

[Production of Thermal Transfer Sheet 2]

Thermal transfer sheet 2 was produced in the same manner as in the production of the thermal transfer sheet 1 except that the transferable protection layer coating solution 1 was replaced with transferable protection layer coating solution 2 having the following composition.

| <Transferable protection layer coating solution 2> | |
|---|---|
| Acrylic resin | 15 weight parts |
| Vinyl chloride - vinyl acetate copolymer | 5 weight parts |
| Copolymer resin reacted and bonded with reactive ultraviolet absorbent (UVA-635L manufactured by BASF Japan Co., Ltd.) | 40 weight parts |
| Polystyrene wax | 0.3 weight parts |
| Polyester resin | 0.1 weight parts |
| Methyl ethyl ketone | 40 weight parts |
| Toluene | 40 weight parts |
| Zinc antimonite (Celnax manufactured by Nissan Chemical Industries, Ltd.) | 20 weight parts |

[Production of Thermal Transfer Sheet 3]

Thermal transfer sheet 3 was produced in the same manner as in the production of the thermal transfer sheet 1 except that the cyan dye layer coating solution 1, magenta layer coating solution 1, and yellow layer coating solution 1 were replaced with cyan dye layer coating solution 2, magenta layer coating solution 2, and yellow layer coating solution 1 having the following composition.

(Cyan Dye Layer Coating Solution 2)

Cyan dye layer coating solution 2 was prepared in the same manner as for the cyan dye layer coating solution 1 except that the post-chelate dye (C-1) was replaced with cyan dispersed dye (C. I. Solvent Blue 63).

(Magenta Dye Layer Coating Solution 2)

Magenta dye layer coating solution 2 was prepared in the same manner as for the magenta dye layer coating solution 1 except that the post-chelate dye (M-1) was replaced with magenta dispersed dye (C. I. Disperse Red 60).

(Yellow Dye Layer Coating Solution 2)

Yellow dye layer coating solution 2 was prepared in the same manner as for the yellow dye layer coating solution 1 except that the post-chelate dye (Y-1) was replaced with 5.5 weight parts of yellow dispersed dye shown below and 90 weight parts of methyl ethyl ketone/toluene (weight ratio 1/1).

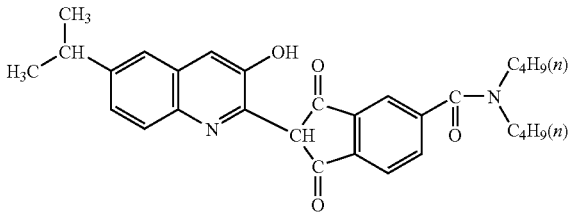

<<Forming an Image>>

Using the thermal transfer image receiving sheets 1 to 35 and thermal transfer sheets 1 to 3 in a combination shown in Table 3, each Y, M and C dye was printed on each thermal transfer image receiving sheet at 255-gradation and also at every 20-gradation by a sublimation thermal printer (CHC-S545 manufactured by Shinko Electric Co., Ltd.), and then each image surface was subjected to post-heat treatment by the same thermal head. Thus, the formed image prints 1 to 37 were produced.

<<Evaluation of Formed Image Print>>

[Electrical Resistance Measurement of Thermal Transfer Image Receiving Sheet]

Electrical resistance of the thermal transfer image receiving sheet was measured before printing and after printing by the salt bridge method according to the aforementioned means.

[Evaluation of Image Conservativeness]

After each print was stored under an ambient condition of 60° C. and 80% RH for 3 months, the residual density ratio before and after the above storage was measured on a portion with density 1.0 on the magenta image. Then, the image storage stability was evaluated according to the following criterion. Density of image was measured by a densitometer X-rite 310 manufactured by X-rite Corporation.

A: Residual magenta density ratio is 90% or more

B: Residual magenta density ratio is 70% or more and less than 90%

C: Residual magenta density ratio is 50% or more and less than 70%

D: Residual magenta density ratio is less than 50%

[Evaluation of Abrasion Resistance]

The surface of the transferable protection layer after transfer was rubbed with plastic eraser continuously for 10 seconds and the residual image density ratio before and after the above rubbing was measured.

A: Residual image density ratio is 90% or more

B: Residual image density ratio is 70% or more and less than 90%

C: Residual image density ratio is 50% or more and less than 70%

D: Residual image density ratio is less than 50%

[Evaluation of Adhesion]

After the process of applying mending tape (manufactured by Sumitomo 3M Ltd.) on the surface of the transferable protection layer and then peeling it off was repeated for 10 times, peeled area on each transferable protection layer, image receiving layer and intermediate layer surface was measured. Then the adhesion was evaluated according to the following criterion.

A: No peel is recognized

B: Peeled area is less than 20% of total taped area

C: Peeled area is 20% or more and less than 50% of total taped area

D: Peeled area is 50% or more and less than 100% of total taped area

E: Peeled area is 100% or more of total taped area "Peeled area is 100% or more" means a wider area than taped is peeled on the transferable protection layer, image receiving layer and intermediate layer.

[Evaluation of Handling Convenience]

Using the thermal transfer image receiving sheet and thermal transfer sheet in a combination as listed in Table 3, ten monochrome prints were printed solid by a sublimation thermal printer (CHC-S545 manufactured by Shinko Electric Co., Ltd.) under an ambient of 23° C. and 55% RH. Then, it was attempted to pile the ten formed image prints together in neat order and the handling convenience was evaluated according to the following criterion.

A: Not caught at all and can be piled in order

B: Slightly caught but can be piled in order easily

C: Relatively badly caught but can be piled in order by efforts

D: Badly caught and cannot be piled in order

The results of the measurement and evaluation are shown in Table 3.

TABLE 3

| Formed image print No. | Thermal transfer image receiving sheet | Thermal transfer sheet No. | Electrical resistance (salt bridge method) Before transfer | After transfer | Evaluation result: Conservativeness | Abrasion resistance | Adhesion | Handling convenience | Remarks |
|---|---|---|---|---|---|---|---|---|---|
| 1 | 1 | 1 | $5.0 \times 10^9$ | $7.2 \times 10^{11}$ | A | A | A | C | Inv. |
| 2 | 2 | 1 | $2.3 \times 10^9$ | $6.1 \times 10^{10}$ | A | A | A | C | Inv. |
| 3 | 3 | 1 | $9.5 \times 10^8$ | $4.7 \times 10^9$ | A | A | A | B | Inv. |
| 4 | 4 | 1 | $6.2 \times 10^8$ | $9.8 \times 10^8$ | A | A | A | B | Inv. |
| 5 | 5 | 1 | $3.7 \times 10^8$ | $7.1 \times 10^8$ | A | A | A | B | Inv. |
| 6 | 6 | 1 | $2.9 \times 10^8$ | $5.5 \times 10^8$ | A | B | C | B | Inv. |
| 7 | 7 | 1 | $1.3 \times 10^8$ | $4.7 \times 10^8$ | A | B | C | B | Inv. |
| 8 | 8 | 1 | $4.1 \times 10^9$ | $7.9 \times 10^{11}$ | A | A | A | C | Inv. |
| 9 | 9 | 1 | $1.8 \times 10^9$ | $7.5 \times 10^{10}$ | A | A | A | C | Inv. |
| 10 | 10 | 1 | $9.1 \times 10^8$ | $4.0 \times 10^9$ | A | A | A | B | Inv. |

TABLE 3-continued

| Formed image print No. | Thermal transfer image receiving sheet | Thermal transfer sheet No. | Electrical resistance (salt bridge method) Before transfer | After transfer | Evaluation result: Conservative-ness | Abrasion resis-tance | Adhesion | Handling conven-ience | Remarks |
|---|---|---|---|---|---|---|---|---|---|
| 11 | 11 | 1 | $5.7 \times 10^8$ | $9.2 \times 10^8$ | A | A | A | B | Inv. |
| 12 | 12 | 1 | $3.6 \times 10^8$ | $6.6 \times 10^8$ | A | A | A | B | Inv. |
| 13 | 13 | 1 | $2.4 \times 10^8$ | $5.1 \times 10^8$ | A | B | C | B | Inv. |
| 14 | 14 | 1 | $1.1 \times 10^8$ | $4.5 \times 10^8$ | A | B | C | B | Inv. |
| 15 | 15 | 1 | $8.5 \times 10^9$ | $8.8 \times 10^{12}$ | A | A | A | D | Comp. |
| 16 | 16 | 1 | $9.0 \times 10^7$ | $4.5 \times 10^8$ | A | D | E | C | Comp. |
| 17 | 17 | 1 | $8.0 \times 10^8$ | $9.1 \times 10^{12}$ | A | A | A | D | Comp. |
| 18 | 18 | 1 | $8.0 \times 10^7$ | $4.9 \times 10^8$ | A | D | E | C | Comp. |
| 19 | 19 | 1 | $5.8 \times 10^8$ | $9.1 \times 10^8$ | A | A | A | A | Inv. |
| 20 | 20 | 1 | $6.4 \times 10^8$ | $1.0 \times 10^9$ | A | A | A | A | Inv. |
| 21 | 21 | 1 | $6.1 \times 10^8$ | $9.7 \times 10^8$ | A | A | A | A | Inv. |
| 22 | 22 | 1 | $8.8 \times 10^8$ | $6.4 \times 10^9$ | A | A | A | A | Inv. |
| 23 | 23 | 1 | $6.0 \times 10^8$ | $9.1 \times 10^8$ | A | A | A | A | Inv. |
| 24 | 24 | 1 | $4.9 \times 10^8$ | $4.3 \times 10^9$ | A | A | A | B | Inv. |
| 25 | 25 | 1 | $3.1 \times 10^8$ | $8.7 \times 10^8$ | A | A | A | B | Inv. |
| 26 | 26 | 1 | $2.7 \times 10^8$ | $8.5 \times 10^8$ | A | A | A | A | Inv. |
| 27 | 27 | 1 | $1.2 \times 10^9$ | $4.5 \times 10^9$ | A | A | A | A | Inv. |
| 28 | 28 | 1 | $6.1 \times 10^8$ | $5.0 \times 10^9$ | A | A | A | A | Inv. |
| 29 | 29 | 1 | $8.9 \times 10^9$ | $2.2 \times 10^{10}$ | A | A | A | A | Inv. |
| 30 | 30 | 1 | $7.1 \times 10^9$ | $1.9 \times 10^{10}$ | A | A | A | B | Inv. |
| 31 | 31 | 1 | $2.5 \times 10^{10}$ | $7.9 \times 10^{10}$ | A | A | A | B | Inv. |
| 32 | 32 | 1 | $4.3 \times 10^9$ | $9.1 \times 10^9$ | A | A | A | A | Inv. |
| 33 | 33 | 3 | $6.5 \times 10^8$ | $1.1 \times 10^9$ | B | A | A | B | Inv. |
| 34 | 34 | 1 | $2.5 \times 10^{11}$ | $9.7 \times 10^{12}$ | A | A | A | D | Comp. |
| 35 | 35 | 2 | $8.2 \times 10^{12}$ | $2.1 \times 10^{11}$ | C | D | A | B | Comp. |

Inv.: Present invention
Comp.: Comparative sample

It is apparent from the results in Table 3 that, on the formed image print using the thermal transfer image receiving sheet and thermal transfer sheet composed according to the present invention, the handling convenience is improved without deteriorating the storage ability and permanence of the transferable protection layer (abrasion resistance and adhesion). In particular, it is understood that the formed image print of which conductive gent content is 35–70% by volume is more preferable because of less conductivity reduction and no adhesion deterioration. It is also understood that, on the formed image print made from the thermal transfer image receiving sheet which uses cellulose type resin on it backing layer, the handling convenience is further improved.

What is claimed is:

1. A thermal transfer image receiving sheet comprising a support having an image receiving layer on one surface of the support and a backing layer on the other surface of the support, an image being formed by a method comprising the steps of:

(i) forming an image via thermal transfer on the thermal transfer image receiving sheet; and (ii) transferring a transferable protection layer from a thermal transfer sheet having a detachable transferable protection layer which is provided at least in a part of the thermal transfer sheet, wherein, (a) a first electrical resistance of the thermal transfer image receiving sheet is in a range of $1\times10^8$–$1\times10^{12}$ ohms per square before the transferable protection layer is transferred; and (b) a second electrical resistance of the thermal transfer image receiving sheet is in a range of $1\times10^8$–$1\times10^{12}$ ohms per square after the transferable protection layer is transferred and after the backing layer is removed, the first and second electrical resistances being measured by a salt bridge method.

2. The thermal transfer image receiving sheet of claim 1, wherein a conductive layer containing a particle conducting agent is further provided on the same surface of the support as the image receiving layer.

3. The thermal transfer image receiving sheet of claim 1, wherein a conductive layer containing a particle conducting agent is further provided between the support and the image receiving layer.

4. The thermal transfer image receiving sheet of claim 2, wherein the conductive agent is selected from the group consisting of a conductive microparticle of crystalline metal oxide, a conductive microparticle of ionic crosslinked polymer and a microparticle of a smectite clay mineral.

5. The thermal transfer image receiving sheet of claim 2, wherein a content of the conductive particle in the conductive layer is in an amount of 25–80% by volume.

6. The thermal transfer image receiving sheet of claim 2, wherein a content of the conductive particle in the conductive layer is in an amount of 35–70% by volume.

7. The thermal transfer image receiving sheet of claim 1, wherein the image receiving layer has a compound containing a metal ion in the molecule which is capable of reacting with a chelatable thermal diffusive dye diffused out of a dye layer provided in the thermal transfer sheet.

8. The thermal transfer image receiving sheet of claim 1, wherein an outermost layer provided on an opposite surface of the support to the image receiving layer contains a cellulose resin as a main component.

9. A method for forming an image comprising the steps of:

(i) forming an image via thermal transfer on the thermal transfer image receiving sheet of claim 1; and (ii) transferring the transferable protection layer from the thermal transfer sheet having the detachable transferable protection layer which is provided at least in a part of the thermal transfer sheet.

* * * * *